US010954093B2

(12) United States Patent
Susaki et al.

(10) Patent No.: US 10,954,093 B2
(45) Date of Patent: Mar. 23, 2021

(54) BINDING APPARATUS, IMAGE FORMING APPARATUS INCORPORATING THE SAME, AND IMAGE FORMING SYSTEM

(71) Applicants: Yuji Susaki, Kanagawa (JP); Natsuki Mio, Kanagawa (JP)

(72) Inventors: Yuji Susaki, Kanagawa (JP); Natsuki Mio, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/671,397

(22) Filed: Nov. 1, 2019

(65) Prior Publication Data

US 2020/0172368 A1 Jun. 4, 2020

(30) Foreign Application Priority Data

Nov. 30, 2018 (JP) ..... 2018-225368

(51) Int. Cl.

| | |
|---|---|
| ***B31F 1/07*** | (2006.01) |
| ***B65H 37/04*** | (2006.01) |
| ***B31F 5/02*** | (2006.01) |
| *G03G 15/00* | (2006.01) |

(52) U.S. Cl.

CPC ..... *B65H 37/04* (2013.01); *B31F 1/07* (2013.01); *B31F 5/02* (2013.01); *B31F 2201/0754* (2019.01); *G03G 15/6544* (2013.01); *G03G 2215/00852* (2013.01)

(58) Field of Classification Search

CPC ..... B31F 1/07; B31F 5/02; B31F 2201/0754; B65H 37/04; B65H 2301/51616; B65H 2301/43828; G03G 15/6544; G03G 2215/00852

USPC ..... 270/58.07, 58.08

See application file for complete search history.

(56) References Cited

U.S. PATENT DOCUMENTS

| | | | | |
|---|---|---|---|---|
| 8,333,372 | B2 * | 12/2012 | Awaya | B65H 37/04 270/58.07 |
| 8,596,633 | B2 * | 12/2013 | Awaya | B65H 37/04 270/58.08 |
| 9,126,794 | B2 * | 9/2015 | Abe | B65H 5/068 |

(Continued)

FOREIGN PATENT DOCUMENTS

| | | | |
|---|---|---|---|
| JP | 2004167700 | A * | 6/2004 |
| JP | 2011-111238 | | 6/2011 |
| JP | 2011-195323 | | 10/2011 |

(Continued)

*Primary Examiner* — Leslie A Nicholson, III

(74) *Attorney, Agent, or Firm* — Harness, Dickey & Pierce, P.L.C.

(57) ABSTRACT

A binding apparatus includes a binding tool, a binding tool driver, a shaft, and control circuitry. The binding tool is configured to execute a first binding process at a first binding position on a sheet bundle and execute a second binding process at a second binding position different from the first binding position on the sheet bundle. The binding tool driver includes a driver and is configured to apply a driving force to move the binding tool and a driving force to execute the first binding process and the second binding process. The shaft is disposed between the binding tool and the binding tool driver to support a movement of the binding tool by application of the driving force to the first binding position and the second binding position.

13 Claims, 19 Drawing Sheets

(56) References Cited

U.S. PATENT DOCUMENTS 10,040,662 B2 * 8/2018 Abe ..... B65H 31/34

FOREIGN PATENT DOCUMENTS

JP 2013-063831 4/2013
JP 2016204071 A * 12/2016

* cited by examiner

BINDING APPARATUS, IMAGE FORMING APPARATUS INCORPORATING THE SAME, AND IMAGE FORMING SYSTEM

CROSS-REFERENCE TO RELATED APPLICATION

This patent application is based on and claims priority pursuant to 35 U.S.C. § 119 to Japanese Patent Application No. 2018-225368, filed on Nov. 30, 2018 in the Japan Patent Office, the entire disclosure of which is hereby incorporated by reference herein.

BACKGROUND

Technical Field

This disclosure relates to a binding apparatus and an image forming apparatus incorporating the binding apparatus and an image forming system.

Background Art

There is a post-processing apparatus that stacks and aligns recording media on which images are formed, executes processes such as binding processes by using a binding apparatus, and then sequentially ejects a bundle of recording media to an ejection tray. The post-processing apparatus is an independent apparatus separate from the image forming apparatus and is coupled to the image forming apparatus to work together and constitute an image forming system. There is also the image forming apparatus installed the post-processing apparatus to constitute one apparatus.

One of the post-processing apparatuses is the binding apparatus that executes the binding processes. There are two types of binding apparatuses: a staple binding apparatus that uses a staple to bind a bundle of recording media, and a non-staple binding apparatus that binds a bundle of recording media without using the staple. The non-staple binding apparatus uses binding teeth made of concave convex teeth as a binding tool. In the non-staple binding apparatus including the binding teeth, the binding teeth sandwich and press the bundle of recording media and intertwines fibers of the recording media and binds the recording media.

The non-staple binding apparatus includes a moving mechanism to move the binding teeth to a predetermined binding position. A high-speed movement of the binding teeth improves productivity of the binding process. However, the high-speed movement of the binding teeth may cause a disadvantage such as noise and vibration.

SUMMARY

This specification describes an improved binding apparatus that includes a binding tool, a binding tool driver, a shaft, and control circuitry. The binding tool is configured to execute a first binding process at a first binding position on a sheet bundle and execute a second binding process at a second binding position different from the first binding position on the sheet bundle. The binding tool driver includes a driver and is configured to apply a driving force to move the binding tool and a driving force to execute the first binding process and the second binding process. The shaft is disposed between the binding tool and the binding tool driver to support movement of the binding tool by application of the driving force to the first binding position and the second binding position.

This specification further describes an improved image forming system that includes an image forming apparatus configured to form an image on a sheet-like medium, a post-processing apparatus including a binding apparatus to bind a sheet bundle including the sheet-like medium on which the image is formed in the image forming apparatus, and control circuitry. The binding apparatus includes a binding tool, a binding tool driver, and a shaft. The binding tool is configured to execute a first binding process at a first binding position on a sheet bundle and execute a second binding process at a second binding position different from the first binding position on the sheet bundle. The binding tool driver includes a driver and is configured to apply a driving force to move the binding tool and a driving force to execute the first binding process and the second binding process. The shaft is disposed between the binding tool and the binding tool driver configured to support movement of the binding tool by application of the driving force to the first binding position and the second binding position.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
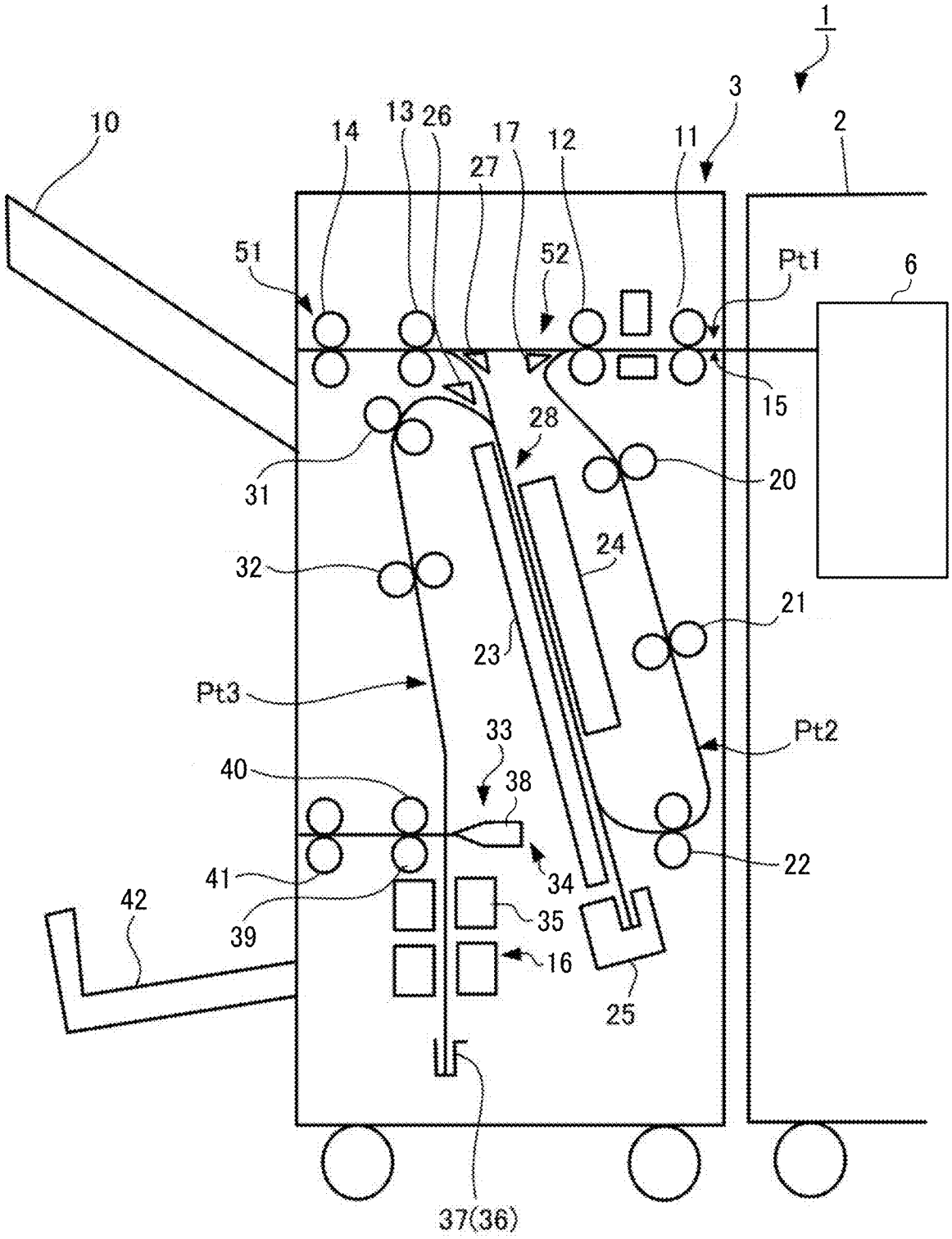
FIG. 1 is a diagram illustrating a configuration of an image forming system according to the present embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

A binding apparatus according the present disclosure relates to a non-staple binding apparatus that executes a non-staple binding job. The binding apparatus drives a binding tool to press and bind sheet-like media and executes binding processes to bind a sheet bundle. The binding apparatus performs a plurality of times of binding processes in one binding job and obtains a more stable bound bundle. In the binding job of the binding apparatus, the binding tool moves to a predetermined position to execute a first binding process and moves to the next adjacent binding position to execute a second binding process. This binding job gives strong binding force. In the binding apparatus according to the present disclosure, the binding job includes the two binding processes and movement of the binding tool between the two binding processes and is referred to as one binding cycle.

Under conditions described above, aspect of the binding apparatus according to the present disclosure is a structure in which a shaft for movement of binding teeth is disposed near a center of gravity of the binding unit including the binding teeth to reduce vibration and shakiness when the binding teeth move in the one binding cycle.

Another aspect of the binding apparatus according to the present disclosure is a structure including a support member to reduce the vibration and shakiness in the binding unit including the binding teeth when the binding teeth move in the one binding cycle and stabilize the binding positions.

Yet another aspect of the binding apparatus according to the present disclosure is a structure in which the movement of the binding unit and a binding operation of the binding teeth are executed by a same driver to reduce the vibration and shakiness when the binding teeth move in the one binding cycle and stabilize the binding positions.

Disposing a heavy object, that is, the binding unit, which moves in the binding job, near the shaft for movement of binding teeth gives a structure in which the center of gravity of the binding apparatus is near the heavy object, and therefore reduces the vibration and shakiness when the binding teeth move. This structure stabilizes the binding job and reduces binding failure, that is, crimping failure.

Additionally, including the support member in the binding apparatus to reduce the shakiness of the binding unit further stabilizes the binding job. In addition, the structure in which a driver for the movement of the binding teeth in the binding unit and a driver for the binding operation are the common driver decreases a heavy component that causes the vibration of the binding unit, reduces the vibration, and lowers a cost of the binding apparatus.

An image forming system 1 according to the present embodiment is described below.

FIG. 1 is a diagram illustrating an entire configuration of the image forming system 1 including a post-processing apparatus 3 according to the embodiment of the present disclosure. As illustrated in FIG. 1, the image forming system 1 includes a printer 2 as an image forming apparatus and the post-processing apparatus 3 including the binding apparatus according to the present disclosure. The printer 2 and the post-processing apparatus 3 are communicably coupled to each other.

In the image forming system 1, after the printer 2 forms an image on a sheet 4 as a sheet of recording medium, the post-processing apparatus 3 receives the sheet 4 from the printer 2 and executes various types of sheet processing on the received sheets 4. The various types of sheet processing include, for example, a process to staple the sheets at end portions and a center-folding process to fold the sheet at center. The center-folding process may include a saddle stitching process. The post-processing apparatus 3 that executes such various types of sheet processing has operating modes such as an ejection mode, an end portion binding mode, and a center-folding mode.

The printer 2 has a known configuration. For example, the printer 2 may be configured as an electrophotographic color image forming apparatus. The printer 2 includes, for example, a controller, an image forming section including an image forming unit and an optical writing unit, a sheet feeder as a medium supply unit, a sheet feeding conveyance path, a scanner, an intermediate transfer unit, a fixing device, a sheet ejection conveyance path, and a sheet conveyance path for the sheet printed in both sides and forms an image on both sides or one side of the sheet 4.

A configuration of the post-processing apparatus 3 is described below.

The post-processing apparatus 3 includes a first conveyance path Pt1 that receives the sheet 4 ejected from the printer 2 and ejects the sheet 4 to a first output tray 10, a second conveyance path Pt2 that diverges from the first conveyance path Pt1 to staple a bundle 5 of the sheets 4 at the end portion of the bundle 5, and a third conveyance path Pt3 that couples the second conveyance path Pt2 to fold and bind the bundle 5 at a center portion of the bundle 5. Each of the conveyance paths Pt1 to Pt3 is formed by, for example, one or more guide members.

The first conveyance path Pt1 includes entrance rollers 11, conveyance rollers 12 and 13, and sheet ejection rollers 14 which are arranged in that order from upstream to downstream in the first conveyance path Pt1. A motor rotates the entrance rollers 11, the conveyance rollers 12 and 13, and the sheet ejection rollers 14 to convey the sheet. An entrance sensor 15 is disposed upstream from the entrance rollers 11 to detect whether the sheet 4 enters the post-processing apparatus 3. A bifurcating claw 17 is disposed downstream from the conveyance rollers 12. The bifurcating claw 17 pivots to switch the posture of the bifurcating claw 17, thereby selecting either one of the second conveyance path Pt2 or a downstream portion in the first conveyance path Pt1 from the bifurcating claw 17 and thus guiding the sheet 4 to the selected path. The bifurcating claw 17 is driven by, for example, a motor or a solenoid.

In the ejection mode, the sheet 4 enters the first conveyance path Pt1 from the printer 2, and the entrance rollers 11, the conveyance rollers 12 and 13, and the sheet ejection rollers 14 convey the sheet 4. The ejection rollers 14 eject the sheet 4 to the first output tray 10. On the other hand, in the end portion binding mode and the center-folding mode, the sheet 4 enters the first conveyance path Pt1 from the printer 2, the entrance rollers 11 and the conveyance rollers 12 convey the sheet 4, and the bifurcating claw 17 changes a conveyance direction of the sheet 4 to the conveyance path Pt2.

The second conveyance path Pt2 includes conveyance rollers 20, 21, and 22, a sheet stacker 23, a first sheet jogger 24, and a first binding unit 25 that is the binding unit for the end portion of the bundle. A motor rotates the conveyance rollers 20, 21, and 22 to convey the sheet 4. A motor drives the first sheet jogger 24. Downstream from the sheet stacker 23, the second conveyance path Pt2 includes bifurcating claws 26 and 27. The bifurcating claws 26 and 27 pivot to switch the postures of the bifurcating claws 26 and 27, thereby selecting either one of the third conveyance path Pt3 or a downstream portion in the first conveyance path Pt1 from the bifurcating claw 17 and thus guiding the sheet 4 to the selected path. The bifurcating claws 26 and 27 are driven by, for example, a motor or a solenoid.

As noted above, the binding apparatus according to the present disclosure relates to the non-staple binding apparatus and includes the first binding unit 25 that is the binding unit for the end portion of the bundle.

In the end portion binding mode, the sheets are sequentially stacked on the sheet stacker 23. A plurality of sheets 4 stacked forms the sheet bundle 5. At this time, a first movable reference fence disposed in the sheet stacker 23 contacts a trailing end of the sheet 4 to align the plurality of sheets 4 in a sheet conveyance direction, and the first sheet jogger 24 aligns the sheets 4 laterally. The sheet stacker 23, the first sheet jogger 24, and the first movable reference fence constitute a first bundling unit 28 that stacks a plurality of sheets 4 to form the sheet bundle 5. The first bundling unit 28 also includes a motor to drive the first sheet jogger 24 and a motor to drive the first movable reference fence.

The first movable reference fence returns the sheet bundle 5 bound at the end portions of the sheets to the first sheet conveyance path Pt1, and the conveyance rollers 13 and the sheet ejection rollers 14 convey the sheet bundle 5 to eject the sheet bundle 5 to the first output tray 10. The sheet ejection rollers 14 are an example of a sheet ejection unit to eject the sheet bundle 5 bound by the first binding unit 25 that is the binding unit for the end portion of the bundle.

On the other hand, in the center-folding mode, after the sheet 4 enters the second conveyance path Pt2, the first movable reference fence and the conveyance rollers 20, 21, and 22 conveys the sheet 4 to the third conveyance path Pt3. The third conveyance path Pt3 includes conveyance rollers 31 and 32 and a saddle stitching and folding unit 33. A motor rotates the conveyance rollers 31 and 32 to convey the sheet 4. The saddle stitching and folding unit 33 includes a center-folding unit 34, a second binding unit 35 that is a saddle stitching unit, and a second bundling unit 36. The saddle stitching and folding unit 33 is an example of a bound portion forming unit. In the third conveyance path Pt3, the conveyance rollers 31 and 32 sequentially convey the sheets 4 to stack the sheets 4 in the second bundling unit 36. A plurality of sheets 4 stacked forms the sheet bundle 5. That is, the second bundling unit 36 stacks the plurality of sheets 4 conveyed by a conveyance unit 51 to form the sheet bundle 5. When the sheet bundle 5 is formed, a second movable reference fence 37 contacts a leading end of the sheet 4 to align the sheets 4 in the sheet conveyance direction, and the second sheet jogger aligns the sheets 4 laterally. Subsequently, the second binding unit 35 that is the saddle stitching unit binds the sheet bundle 5 in the vicinity of the center of the sheets in the sheet conveyance direction, that is, executes the saddle stitching process. The saddle-stitched sheet bundle 5 is returned to a center-folding position by the second movable reference fence 37. A motor drives the second movable reference fence 37.

After the sheet bundle 5 is positioned at the center-folding position, the center-folding unit 34 folds the sheet bundle 5 at the center of the sheet bundle 5 in the sheet conveyance direction, that is, executes the center-folding process. In the center-folding unit 34, the sheet bundle 5 is positioned at the center-folding position, and a blade 38 faces the center of the sheet bundle 5 in the sheet conveyance direction. The blade 38 moves from the right to the left in FIG. 1 to push the sheet bundle 5 between a pair of pressing rollers 39 and 40 while the blade 38 bends the sheet bundle 5 at the center of the sheet bundle 5. A motor drives the blade 38. The pair of pressing rollers 39 and 40 presses the top and bottom of the folded sheet bundle 5. A motor rotates the pair of pressing rollers 39 and 40. The pressing rollers 39 and 40 and sheet ejection rollers 41 eject the folded sheet bundle 5 onto the second output tray 42. A motor drives the sheet ejection rollers 41.

The entrance rollers 11, the conveyance rollers 12, 13, 20, 21, 22, 31, and 32 and the sheet ejection rollers 14 and 41 described above constitute a conveyance unit 51 together with the motors that drive the rollers 11, 12, 13, 14, 20, 21, 22, 31, 32, and 41 in the conveyance unit 51. The bifurcating claws 17, 26 and 27 constitute a path switching unit 52 together with the motor or the solenoid for driving the bifurcating claws 17, 26 and 27.

A functional block diagram of the post-processing apparatus 3 is described below.

Figure 2:
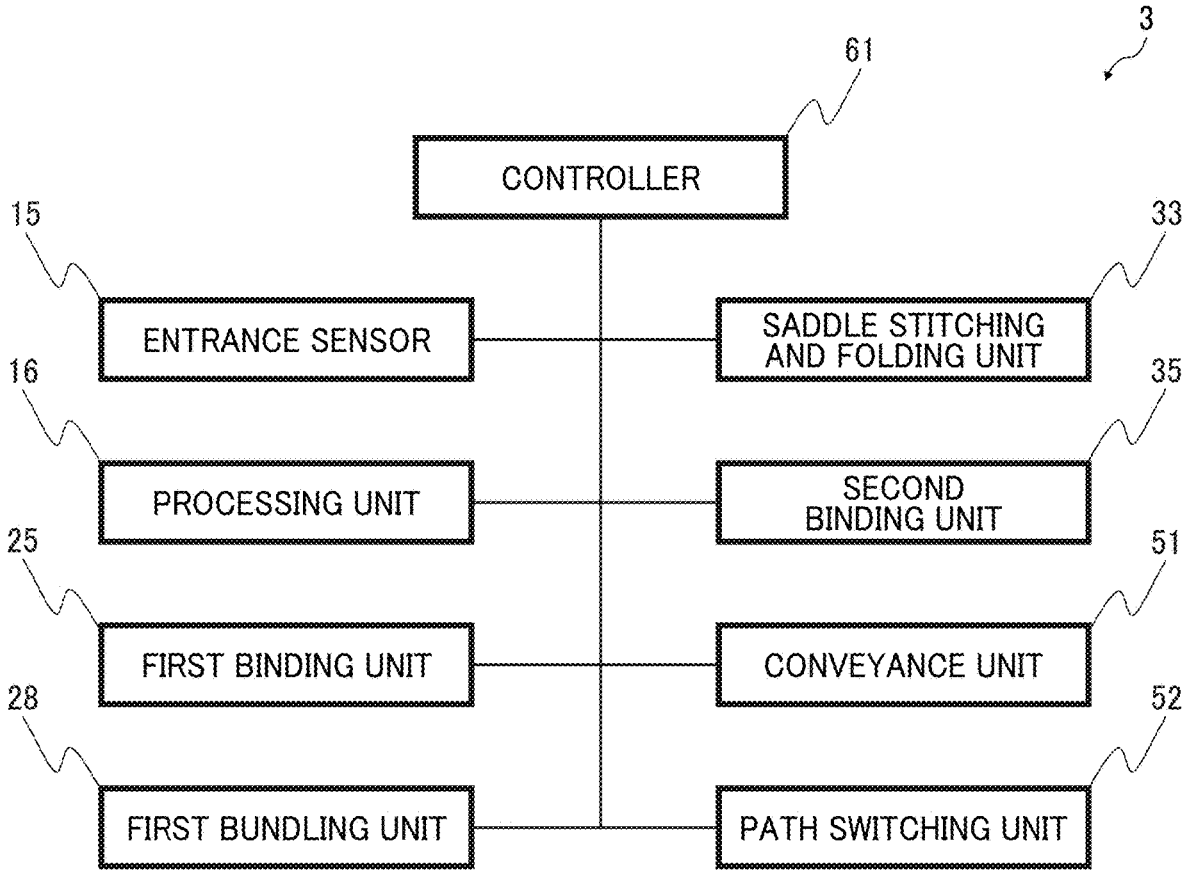
FIG. 2 is a functional block diagram of the image forming system in FIG. 1.

With reference to FIG. 2, the functional configuration of the post-processing apparatus 3 including the binding apparatus in the present embodiment according to the present disclosure is described.

As illustrated in FIG. 2, the post-processing apparatus 3 includes the controller 61. The controller 61 is a computer including a central processing unit (CPU), a memory, and a communication interface. The memory in the controller 61 includes a read-only memory (ROM), a random-access memory (RAM), and the like and stores programs executed by the CPU.

The controller 61 is coupled to the entrance sensor 15, a processing unit 16, the first bundling unit 28, the first binding unit 25 that is the binding unit for the end portion of the bundle, the second binding unit 35 that is the saddle stitching unit, the saddle stitching and folding unit 33, the conveyance unit 51, the path switching unit 52. The controller 61 (CPU) controls and drives each unit of the post-processing apparatus 3 according to the programs stored in the memory. The controller 61 is also coupled to a controller in the image forming apparatus to transmit and receive data. The controller 61 may be disposed in the image forming apparatus and control the post-processing apparatus 3.

An overall configuration of the post-processing apparatus 3 is described below.

Figure 3A:
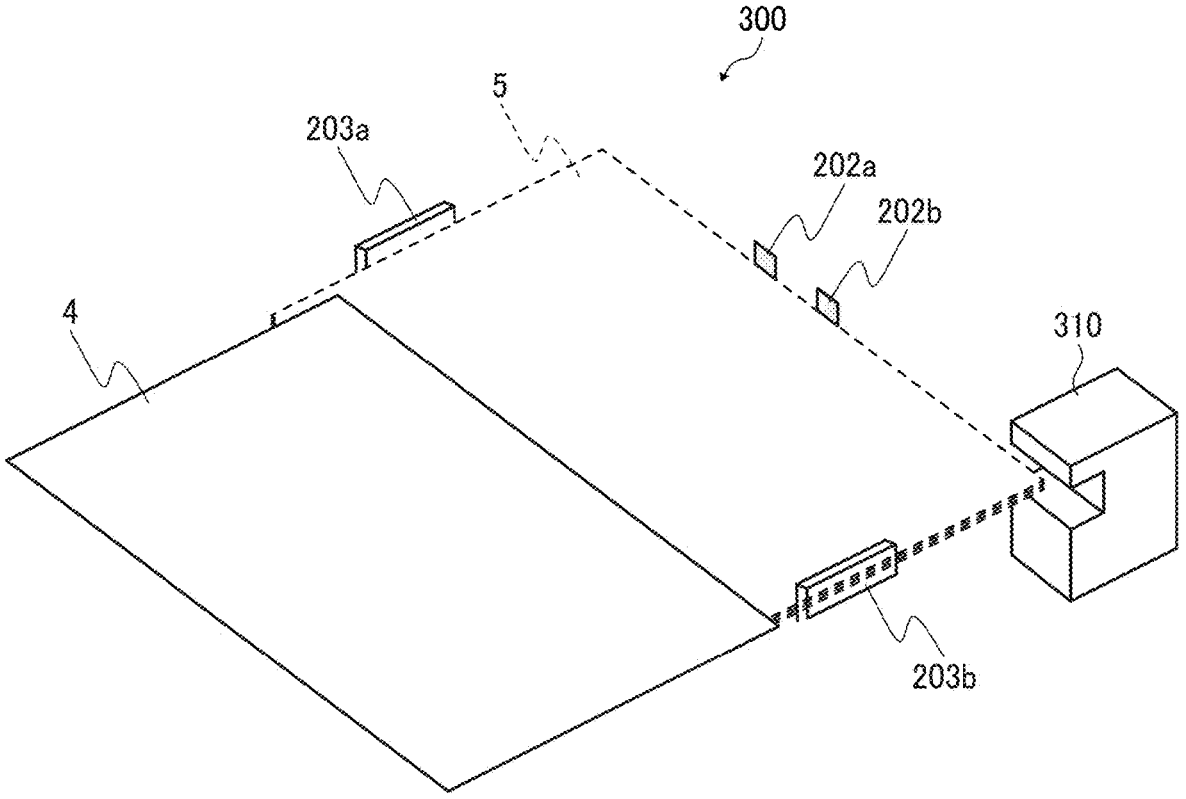
FIG. 3A is a perspective view illustrating an overview of a binding apparatus according to the present embodiment of the present disclosure.
Figure 3B:
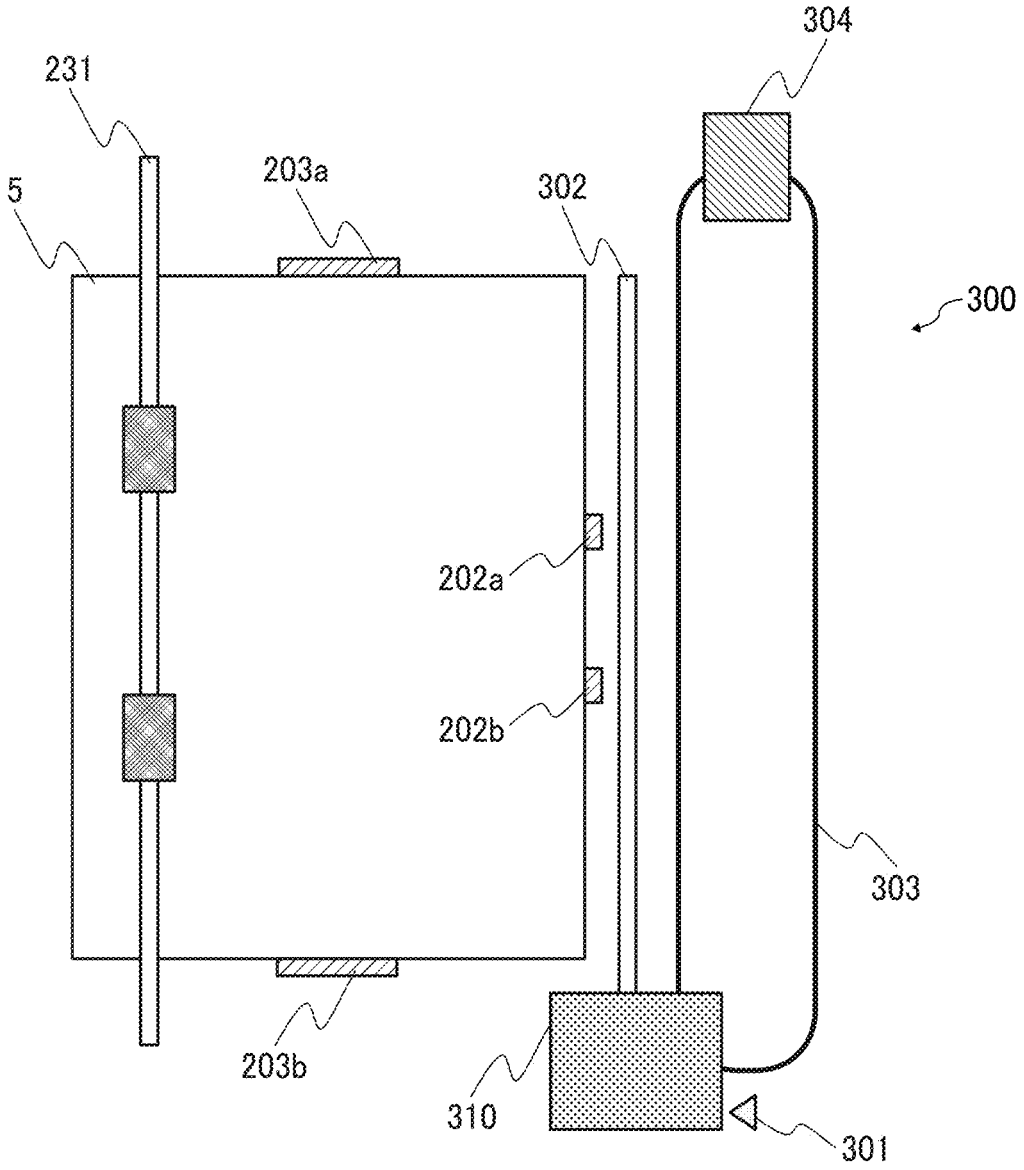
FIG. 3B is a top view illustrating the overview of the binding apparatus according to the present embodiment of the present disclosure.

A description is given of a binding apparatus 300 that executes the non-staple binding process in the post-processing apparatus 3 including the binding apparatus of the present embodiment according to the present disclosure, FIG. 3A is a perspective view illustrating an overview of the binding apparatus 300, and FIG. 3B is a top view illustrating the overview of the binding apparatus 300.

A pair of jogger fences 203*a* and 203*b* aligns, in a sheet width direction, the sheets 4 conveyed and stacked by the conveyance rollers 231 in the first binding unit 25 illustrated in FIG. 1 that is the binding unit for the end portion of the bundle. The sheets 4 aligned in the sheet width direction are aligned in the sheet conveyance direction by a tapping roller with reference to trailing end alignment stoppers 202*a* and 202*b* which are sheet abutting members.

As illustrated in FIG. 3B, a binding unit home position sensor 301 is disposed outside of the jogger fence 203*b* and detects a home position (initial position) of a binding unit 310 in the binding apparatus 300.

An example of Operations of the binding apparatus 300 is described below.

Figure 4A:
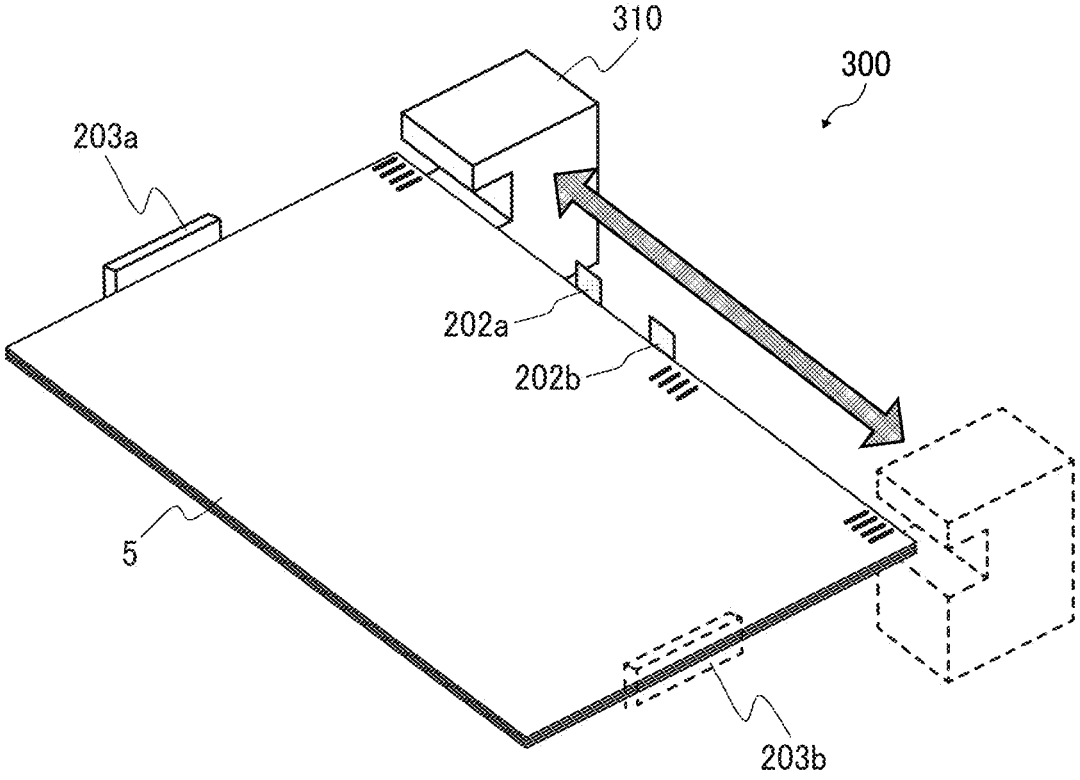
FIG. 4A is a perspective view illustrating an operation of the binding apparatus according to the present embodiment of the present disclosure.
Figure 4B:
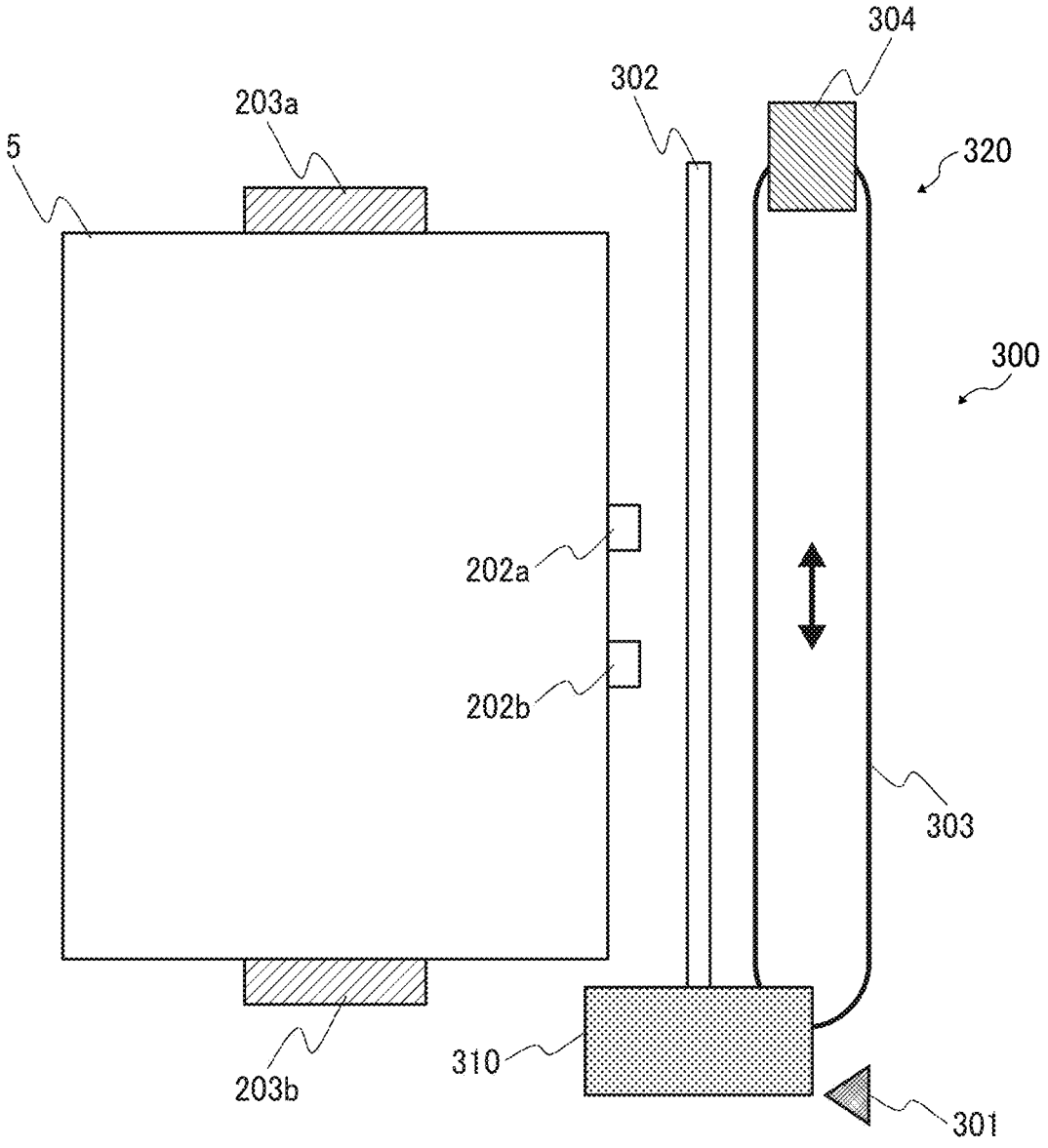
FIG. 4B is a top view illustrating the operation of the binding apparatus according to the present embodiment of the present disclosure.

FIGS. 4A and 4B are diagrams illustrating binding operations of the binding apparatus 300. As illustrated in FIG. 4B, a guide rail 302 for movement of the binding unit 310 is disposed along the sheet width direction and across an entire area of a binding tray in the sheet width direction and stably guides the binding unit 310 in the binding apparatus 300 so that the binding unit 310 can reciprocate in the sheet width direction. To reciprocate the binding unit 310 in the sheet width direction, a unit movement motor 304 as a first driver to move the binding unit 310 rotates. The unit moving belt 303 is wound around a rotation shaft of the unit movement motor 304 and a rotating body disposed opposite the rotation shaft of the unit movement motor 304. The unit movement motor 304 as a driver rotates to move the unit moving belt 303, the movement of the unit moving belt 303 moves the binding unit 310 along the guide rail 302 at a predetermined speed.

A configuration of binding teeth 322 is described below.

Figure 5A:
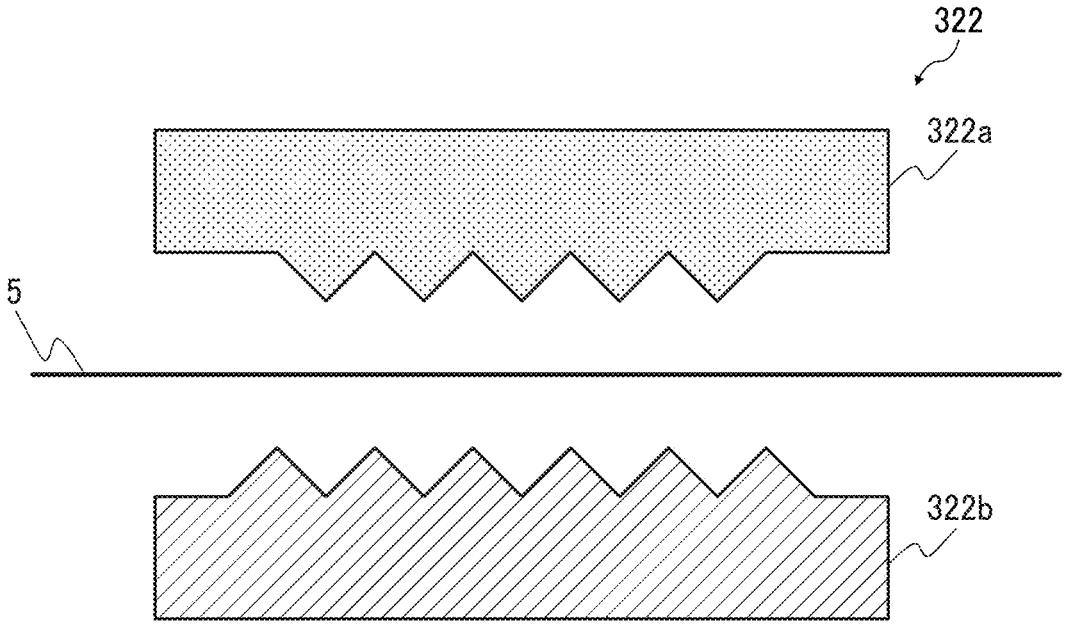
FIGS. 5A and 5B are explanatory diagrams illustrating an embodiment of a binding tool in the binding apparatus.
Figure 5B:
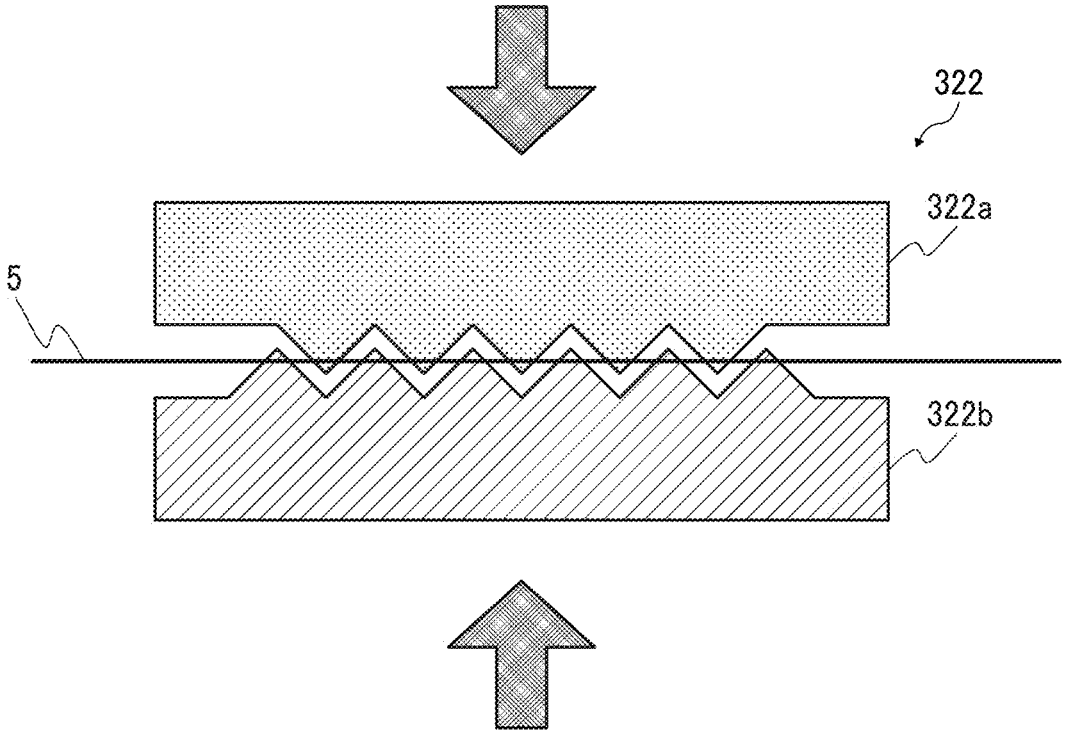

With reference to FIG. 5, a configuration of the binding teeth 322 that is the binding tool in the binding apparatus according to the present embodiment of the present disclosure is described. FIGS. 5A and 5B are side views of the binding teeth 322 in the binding unit 310 that is the non-staple binding apparatus. The binding teeth 322 include upper binding teeth 322*a* and lower binding teeth 322*b*. FIG. 5A illustrates an example of a state before the binding operation of the binding teeth 322. In FIG. 5A, the sheets 4 are conveyed and stacked to form the sheet bundle 5 placed between the upper binding teeth 322*a* and the lower binding teeth 322*b*.

FIG. 5B illustrates an example of a state of the binding teeth 322 during the binding operation. The upper binding teeth 322*a* and the lower binding teeth 322*b* are formed as concave and convex teeth so that they can mesh with each other. When the sheet bundle 5 to be bound is placed between the upper binding teeth 322*a* and the lower binding teeth 322*b*, a driving force of a driver described below in the binding unit 310 drives the upper binding teeth 322*a* and the lower binding teeth 322*b* to close a gap between both binding teeth, and the upper binding teeth 322*a* and the lower binding teeth 322*b* press the sheet bundle 5. The pressing force from the upper binding teeth 322*a* and the lower binding teeth 322*b* entangles the fibers of sheets 4 in the sheet bundle 5 with each other. The entanglement of the fibers of the sheets 4 strongly binds the plurality of sheets 4 together and thus binds the sheet bundle 5. Therefore, the stronger the pressing force is, the stronger the binding force that maintains a bound state of the sheet bundle 5 is. The controller controls the driver so that the binding teeth 322 press the sheet bundle 5 with a constant force, and the binding force in the sheet bundle 5 after one binding process is constant even when a thickness of the sheet bundle is different.

In the present embodiment, the binding force means a force to maintain the bound state of the sheet bundle 5 on which the non-staple binding process is executed. Therefore, if the binding force is large (that is, strong), the bound state of the sheet bundle 5 is stable.

Figure 6A:
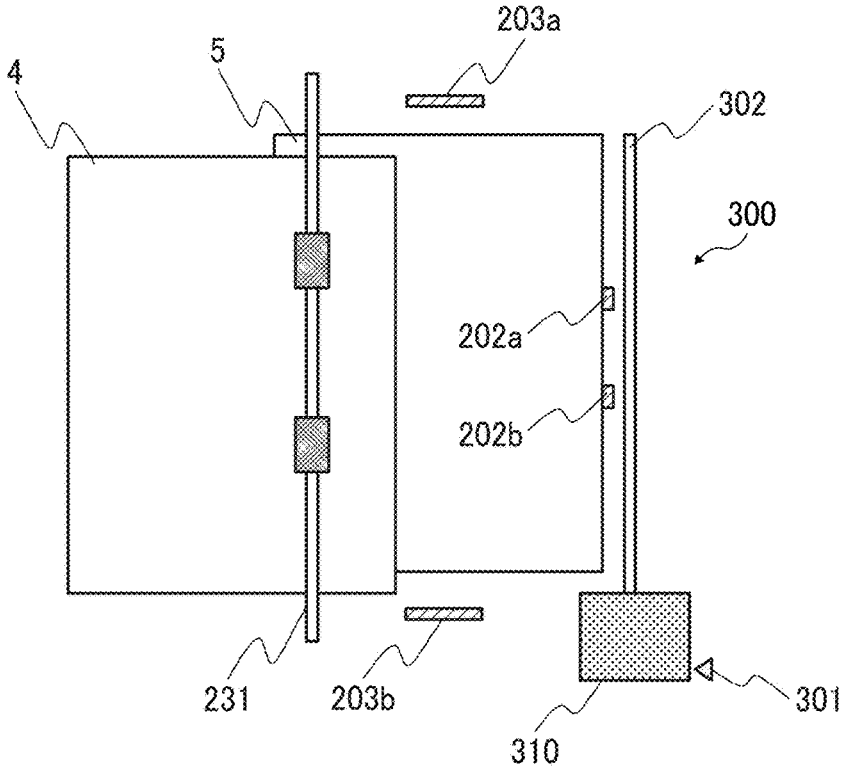
FIGS. 6A to 6C are explanatory diagrams illustrating an example of aligning operation in the binding apparatus according to the present embodiment.
Figure 6B:
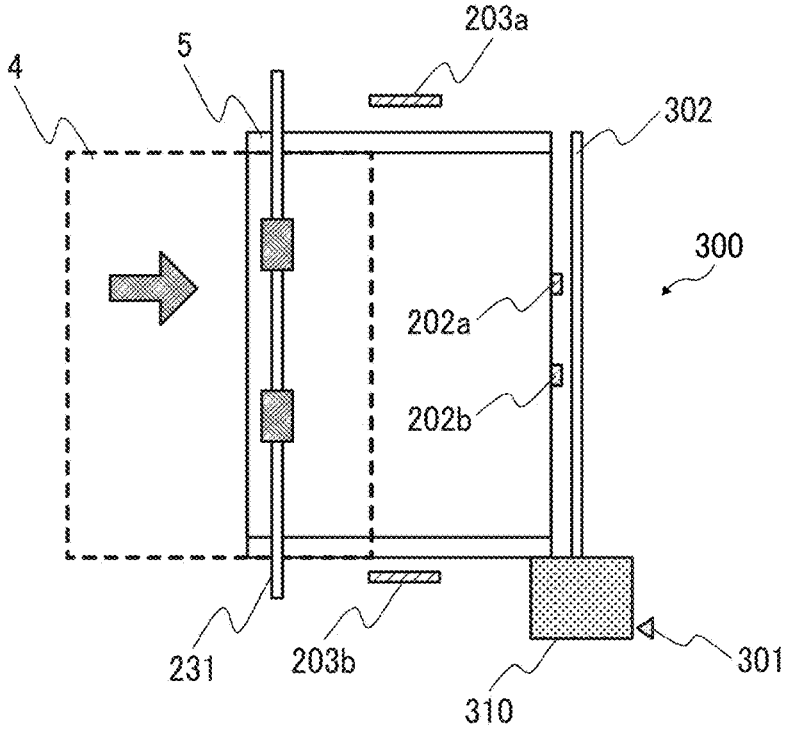
Figure 6C:
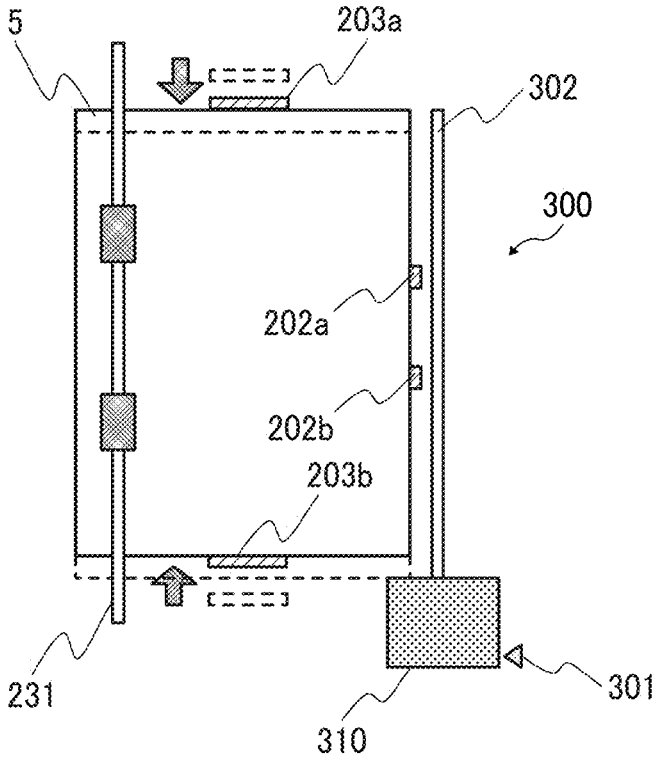

With reference to FIGS. 6A to 6C, an alignment operation for the sheets 4 to form the sheet bundle 5 is described. FIG. 6A illustrates a state when the sheet 4 is conveyed to an alignment position. FIG. 6B illustrates a state when the sheet 4 arrives the alignment position. FIG. 6C illustrates a state when the sheet 4 is aligned with the sheet bundle 5 at the alignment position.

The sheet 4 conveyed to the post-processing apparatus 3 is conveyed to an alignment portion by the conveyance rollers 231 and contacts the trailing end alignment stoppers 202*a* and 202*b* to align the sheet 4 in the sheet conveyance direction. After the sheet 4 contacts the trailing end alignment stoppers 202*a* and 202*b*, the jogger fences 203*a* and 203*b* move to align the sheets 4 laterally, and the alignment of the sheet 4 with the sheet bundle 5 is completed.

Figure 7:
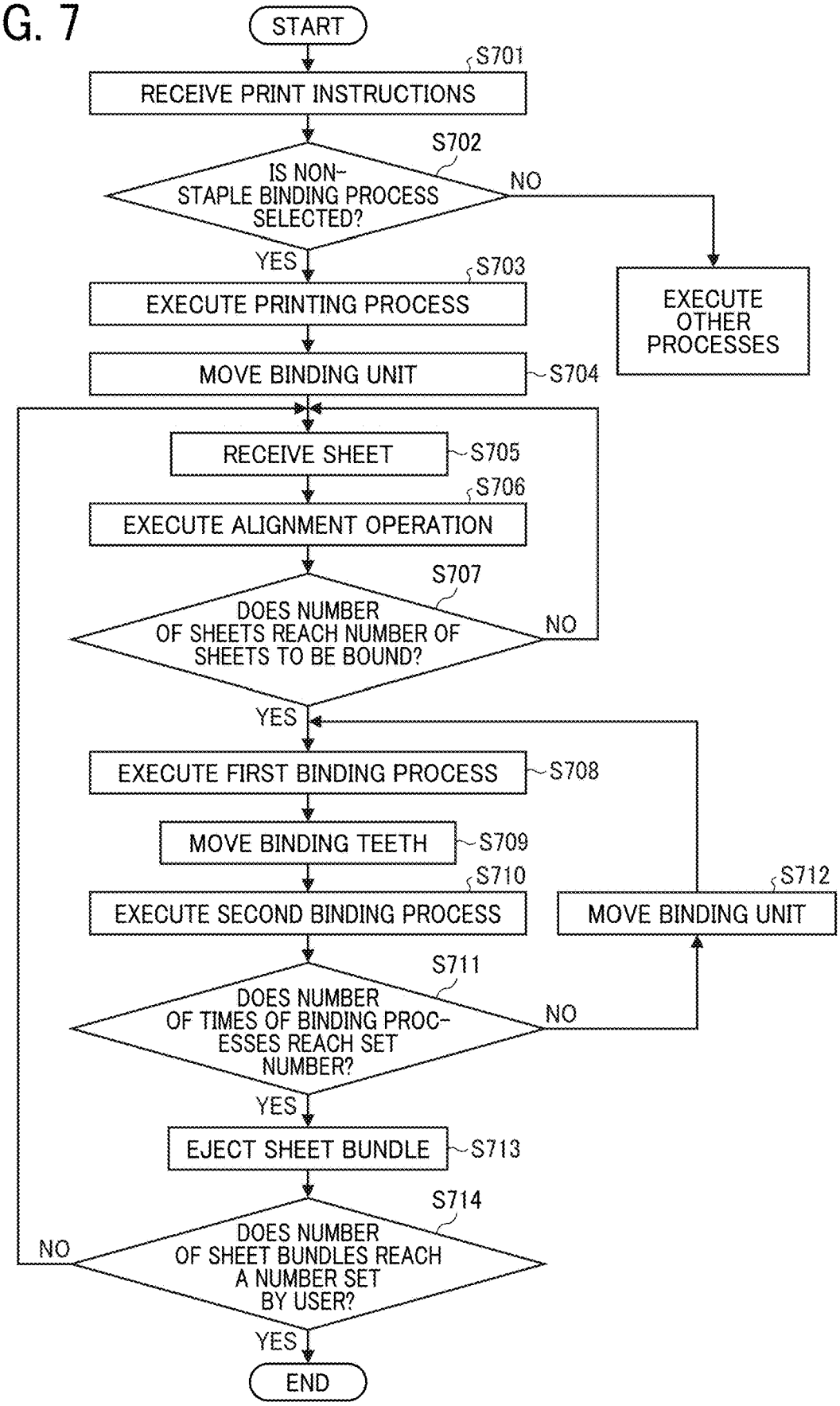
FIG. 7 is a flow chart illustrating operations of the image forming system according to the present disclosure.

Next, with reference to a flow chart in FIG. 7, a description is given of an example of a flow of processes in the image forming system 1 according to the present embodiment.

The flow chart in FIG. 7 illustrates the example of processes in a finisher of the image forming system 1 from the start of the print job to the completion of the sheet ejection in the print job set by a user.

First, the user turns on the printer 2 and sets print modes, that is, selects settings for a print product printed on a recording medium or recording media, such as setting one sided print or double-sided print and setting a gathering process, a stapling process, and a punching process. The printer 2 receives a print instruction in accordance with the set print modes in step S701. Receiving the print instructions, the printer 2 determines whether the non-staple binding process is selected in the set print modes in step S702. When the non-staple binding process is not selected, that is, NO in step S702, the printer executes the print instruction based on the set print modes and executes other processes.

When the non-staple binding process is selected, that is, YES in step S702, the printer 2 executes a printing process in step S703 based on conditions set by the user. After execution of the printing process, the binding unit 310 in the binding apparatus 300 moves to execute the non-staple binding process according to the set sheet size condition in step S704. As described with reference to FIG. 6, the post-processing apparatus 3 receives the sheets 4, forms the sheet bundle 5 in step S705, and executes the alignment operation for the sheet bundle 5 in step S706.

The post-processing apparatus 3 receives setting data about the print product from the printer 2 and determines whether number of sheets 4 received reaches number of sheets to be bound based on the setting data in step S707. When the number of sheets 4 does not reach the number of sheets to be bound, that is, NO in step S707, the post-processing apparatus 3 continues to receive the sheet 4 in step S705.

When the number of sheets reaches the number of sheets to be bound, that is, YES in step S707, the driver drives so that the binding teeth 322 works, and the binding unit 310 executes the first binding process in step S708 because the binding unit 310 already reaches the first stop position to execute the first binding process.

Subsequently, in step S709, the binding unit 310, that is, the binding teeth 322 moves to the second stop position at which the binding unit 310 executes the second binding process. Then, the driver drives again so that the binding teeth 322 works, and the binding unit 310 executes the second binding process in step S710. Thereafter, the controller determines whether the number of times of binding processes reaches a set number in step S711.

When the number of times of binding processes does not reach the set number, that is, NO in step S711, the unit movement motor 304 is driven to move the binding unit 310 to a predetermined position (for example, a next binding position) in step S712. Then, the binding unit 310 executes the binding process again in step S708.

When the number of times of binding processes reaches the set number, that is, YES in step S711, the first movable reference fence, the conveyance rollers 13, and the sheet ejection rollers 14 eject the bound sheet bundle 5 to the first output tray 10 in step S713. Thereafter, the controller determines whether a number of the sheet bundles reaches a number of sheet bundles set by the user in step S714. When the number of the sheet bundles does not reach the set number of sheet bundles, that is, NO in step S714, the controller returns the process to receive the sheet in step S705, and the post-processing apparatus 3 repeats processes from step S705 to receive the sheet to step S713 to eject the sheet bundle until the number of the sheet bundles reaches the set number of sheet bundles. When the number of the sheet bundles reaches the set number of sheet bundles, that is, YES in step S714, the controller completes the processes.

Next, a first embodiment of the binding tool in the binding apparatus according to the present disclosure is described in detail.

Figure 8:
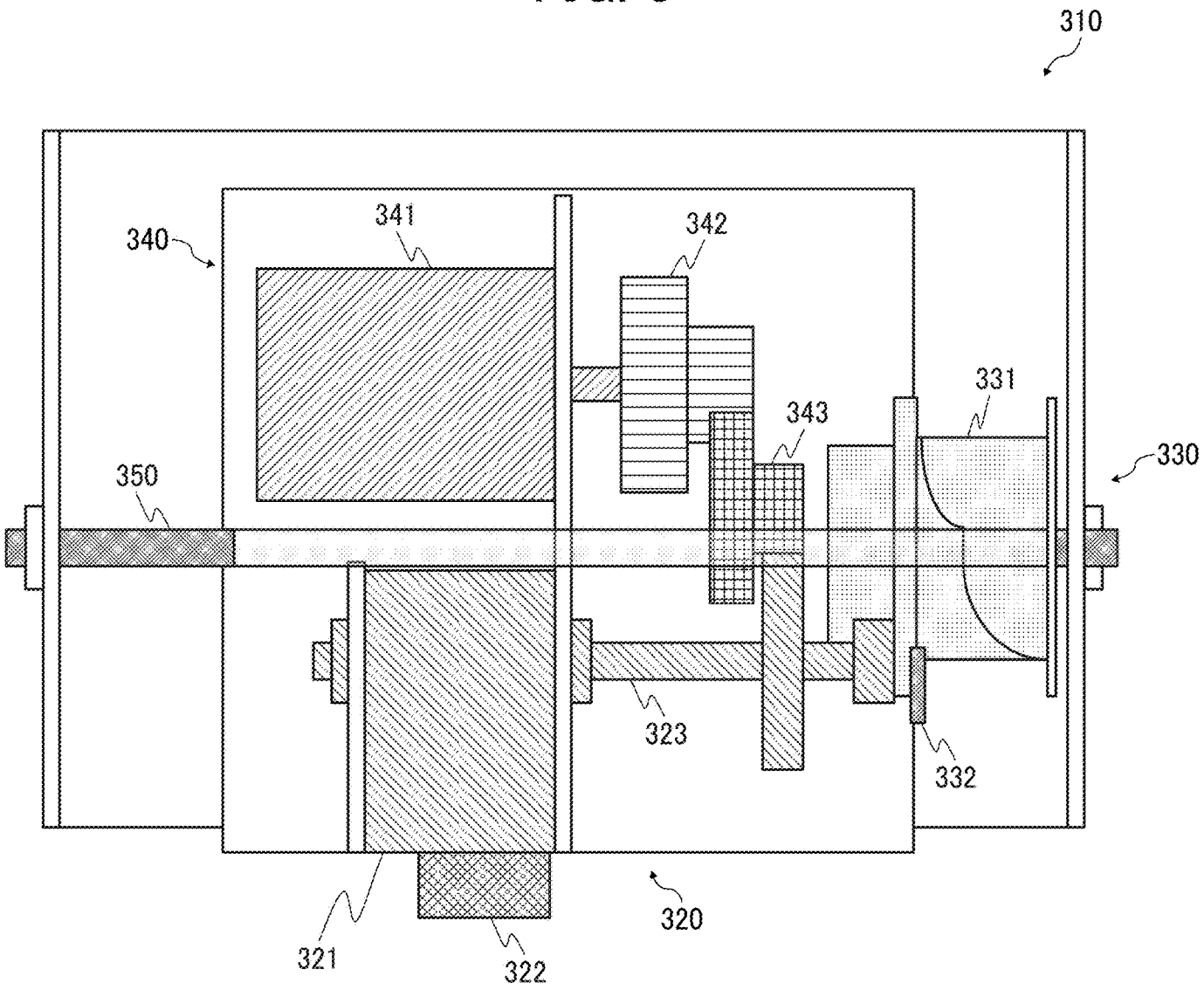
FIG. 8 is a top view illustrating a configuration of an interior of the binding unit in the post-processing apparatus according to the present disclosure.
Figure 9:
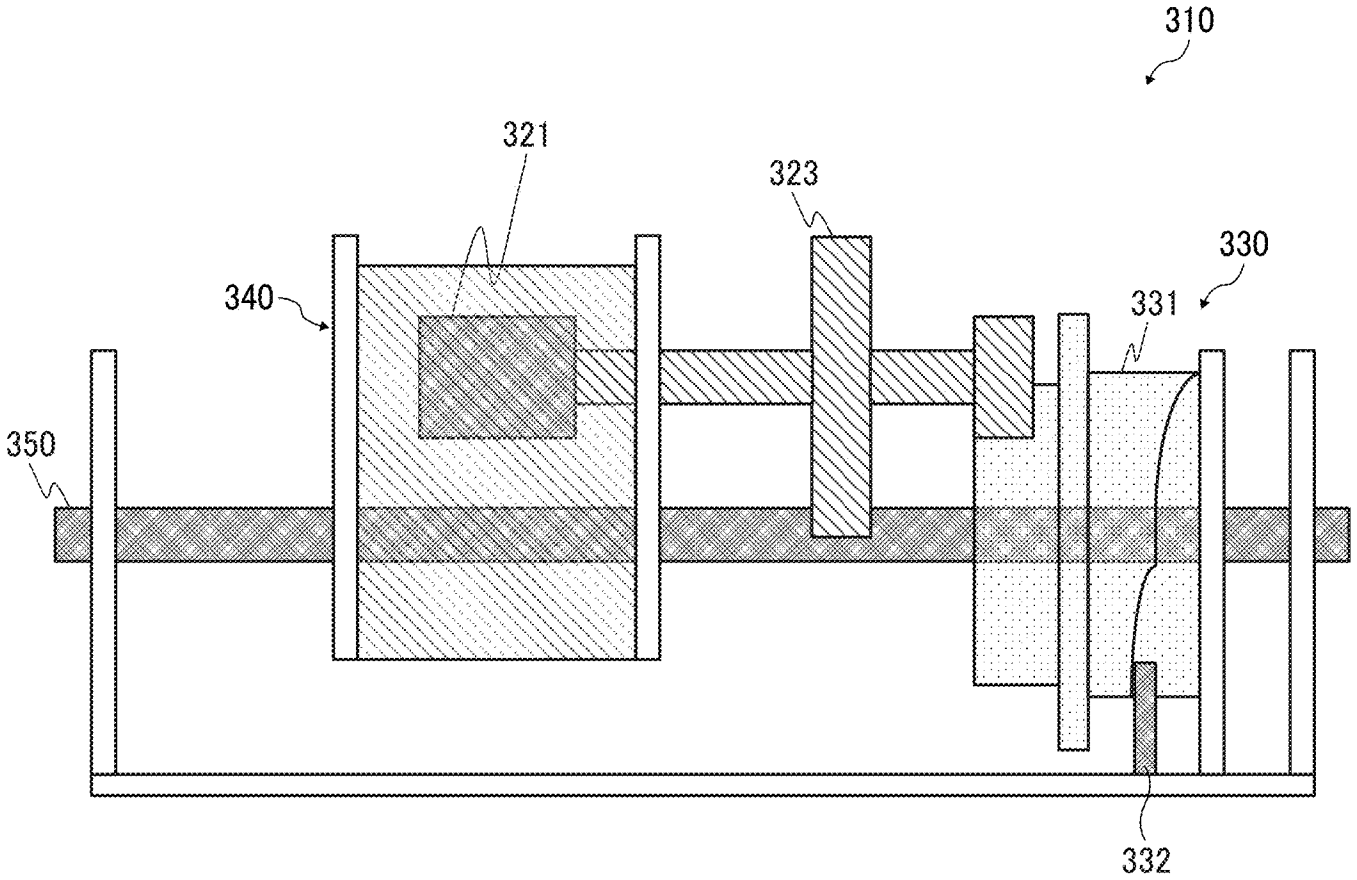
FIG. 9 is a side view illustrating a configuration of an interior of the binding unit in the post-processing apparatus according to the present disclosure.

FIG. 8 is a top view illustrating an internal structure of the binding unit 310 that constitutes the binding tool according to the first embodiment. FIG. 9 is a side view illustrating an internal structure of the binding unit 310. As illustrated in FIGS. 8 and 9, the binding unit 310 includes a clamping unit 320, a clamping unit controller 330, a unit driver 340, and a unit shaft 350.

The clamping unit 320 includes a clamping controller 321 that operates the binding teeth 322 used in the binding processes that are clamping processes on the sheet bundle 5 and a cam transmission mechanism 323 that transmits a driving force generated by the cam 331 in the clamping unit controller 330. The clamping unit 320 is pressed against the clamping unit controller 330.

The clamping unit controller 330 includes a cam 331 rotated by a drive motor 341, and a cam support portion 332 that transmits the rotation of the cam 331 as a driving force to move the clamping unit 320 and a driving force to operate the binding teeth 322.

The unit driver 340 includes a drive motor 341 as the driver, a first transmission mechanism 342 and a second transmission mechanism 343 that transmit a driving force of the drive motor 341 to the cam 331. The unit driver 340 serves as a binding unit driver.

Rotation of the drive motor 341 is transmitted by the first transmission mechanism 342 and the second transmission mechanism 343 and rotates the cam.

The unit shaft 350 is a guide to guide the clamping unit 320 and the unit driver 340 that move in an axial direction of the unit shaft 350.

The drive motor 341 rotates and generates a driving force, and the transmission mechanism transmits the driving force to the cam 331. The driving force from the unit driver 340 rotates the cam 331. Since the rotation of the cam 331 moves the clamping unit 320, the rotational speed of the drive motor 341 determines the speed of movement of the clamping unit 320 and the speed of the binding processes of the binding teeth 322.

The drive motor 341 is, for example, in the present embodiment, an electric motor.

Therefore, the speed of the movement of the clamping unit 320 depends on the rotational speed of the drive motor 341. The binding force determined by the pressing force of the binding teeth 322 also depends on the rotational speed of the drive motor 341. In the binding unit 310 according to the present embodiment, the drive motor 341 as the same driver also moves the clamping unit 320 and drives the operations of the binding teeth 322.

In the binding unit 310, an operation of the clamping controller 321 in the clamping unit 320 synchronizes with the movement of the clamping unit 320 caused by the rotation of the cam 331 caused by the rotation of the drive motor 341. This configuration determines the timing of the movement of the clamping unit 320 and the timing of the binding process in the binding teeth 322.

Next, an example of the rotation of cam 331 and the operation of the clamping unit 320 in the binding unit 310 is described.

The cam 331 rotates in accordance with the rotational speed of the drive motor 341. The cam 331 also has a sloped portion and a flat portion that are continuously connected. The cam support portion 332 is disposed so that the cam support portion 332 contacts the sloped portion and the flat portion of the cam 331. The sloped portion and the flat portion of the cam 331 are configured to contact the cam support portion 332 twice during one rotation of the cam 331.

While the sloped portion contacts the cam support portion 332, the rotating cam 331 presses the sloped portion against the cam support portion 332. This pressing force is a force in a direction along the axial direction of the unit shaft 350 and is converted into a driving force to move the clamping unit 320. The cam transmission mechanism 323 transmits this driving force to the clamping controller 321, and the clamping unit 320 moves along the unit shaft 350. This driving force is larger than a force that presses the clamping unit 320 against the clamping unit controller 330. The clamping controller 321 may be configured to gradually move the binding teeth 322 while the clamping unit 320 moves.

Figure 10:
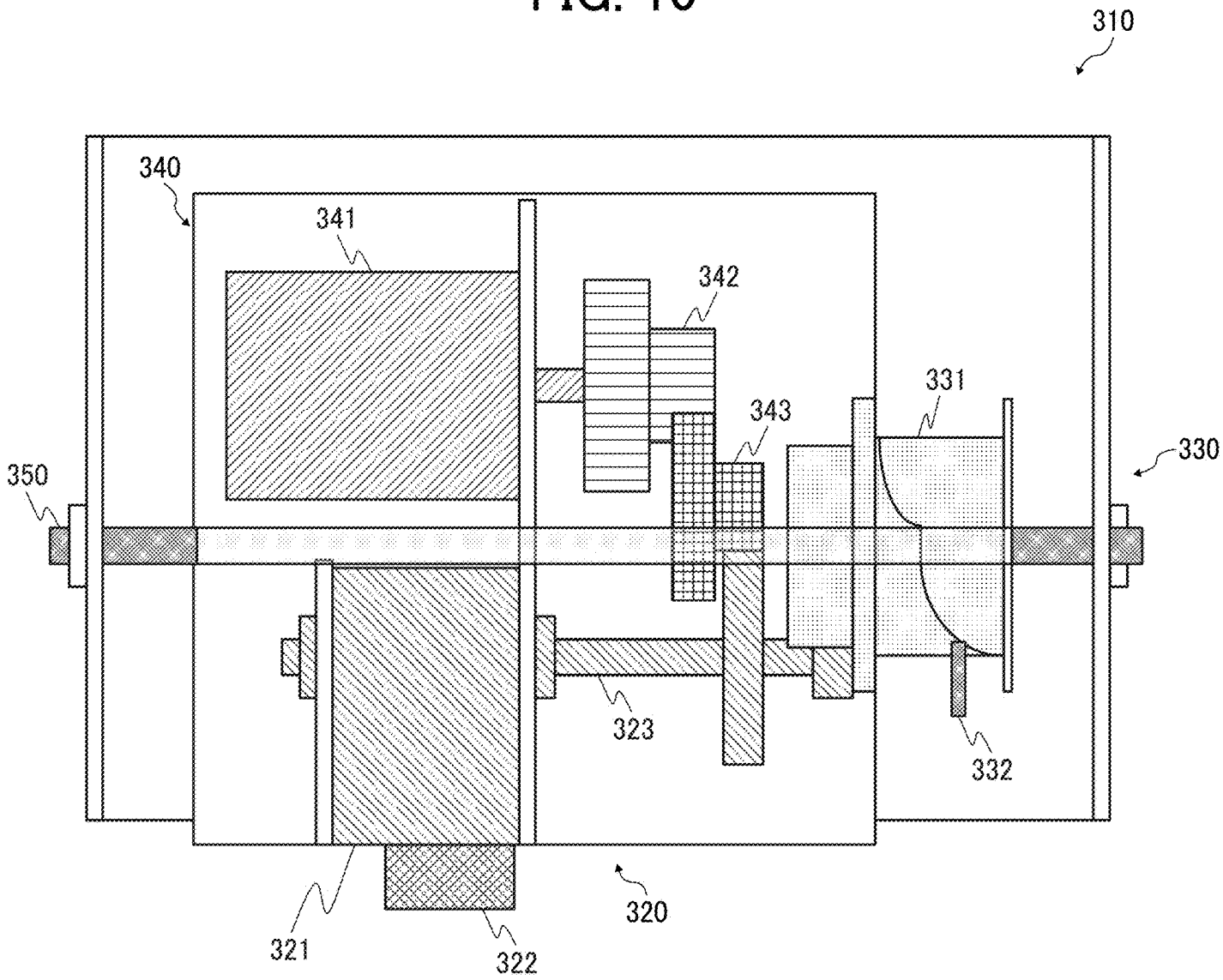
FIG. 10 is a top view illustrating a state of the interior of the binding unit during a binding job.

FIG. 10 illustrates the binding unit 310 when the clamping unit moves. As illustrated in FIG. 10, the clamping unit 320 moves along the unit shaft 350.

While the flat surface portion contacts the cam support portion 332 after the sloped portion contacts the cam support portion 332, the clamping controller 321 works so that the binding teeth 322 binds the sheet bundle. As a result, the binding unit 310 executes the first binding process for the sheet bundle 5.

After the first binding process, when the sloped portion contacts the cam support portion 332 after the flat portion contacts the cam support portion 332, the clamping controller 321 opens the binding teeth 322 and releases the bound sheet bundle 5.

Then, a change of a contact position at which the sloped portion contacts the cam support portion 332 moves the clamping unit 320 to the second stop position where the second binding process is performed.

After the movement of the clamping unit 320, when the flat portion contacts the cam support portion 332 after the sloped portion contacts the cam support portion 332, the clamping controller 321 works so that the binding teeth 322, binds the sheet bundle. As a result, the binding unit 310 executes the second binding process for the sheet bundle 5.

After the second binding process, when the sloped portion contacts the cam support portion 332 after the flat portion contacts the cam support portion 332, the clamping controller 321 opens the binding teeth 322 and releases the bound sheet bundle 5, and the pressing force that constantly presses the clamping unit 320 moves the clamping unit 320 to an initial position.

As described above, the clamping unit 320 and the unit driver 340 are configured so that the clamping unit controller 330 works the clamping unit 320 and the unit driver 340 to move together in the axial direction of the unit shaft 350. The driver of the binding unit 310 is one driver, that is, the drive motor 341.

The unit shaft 350 is disposed between the clamping unit 320 and the unit driver 340. The clamping unit 320 and the unit driver 340 are heavy components in the components included in the binding unit 310. In the binding unit 310, heavy components such as the clamping unit 320 and the unit driver 340 are separately disposed in a planar direction perpendicular to a direction of movement of the clamping unit. This arrangement results in the unit shaft 350 being positioned near the center of gravity of the binding unit 310.

In other words, in the binding unit 310 according to the present embodiment, the unit shaft 350 is disposed between the clamping unit 320 and the unit driver 340 in a horizontal direction in a housing of the binding unit 310.

Additionally, in other words, in the binding unit 310 according to the present embodiment, the unit shaft 350 is sandwiched between the clamping unit 320 and the unit driver 340 that are disposed in a direction perpendicular to the movement direction of the clamping unit 320 that is the axial direction of the unit shaft 350, and the clamping unit 320 faces the unit driver 340 via the unit shaft 350.

Further, in the binding unit 310 according to the present embodiment, the clamping unit 320 is arranged opposite the unit driver 340 via the unit shaft 350 in a direction parallel to an imaginary plane including the axial direction of the unit shaft 350 and a direction perpendicular to a direction in which the upper binding teeth 322*a* and the lower binding teeth 322*b* mesh with each other during the binding process of the binding teeth 322.

The above-described arrangement reduces the vibration and shakiness when the clamping unit 320 and the unit driver 340 move in the axial direction. This structure reduces the vibration of the binding teeth 322 during the binding job and stabilizes the binding job.

Next, a second embodiment of the binding tool in the binding apparatus according to the present disclosure is described.

Figure 11:
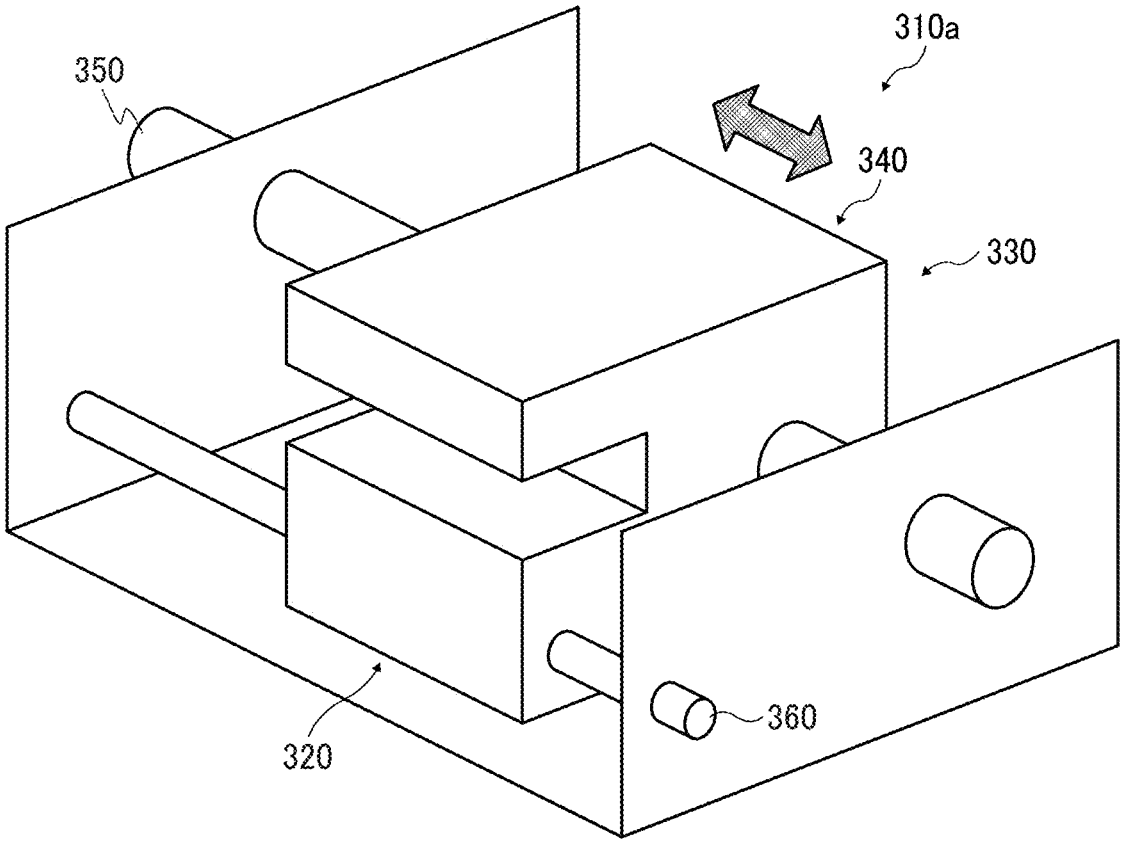
FIG. 11 is an explanatory diagram illustrating a structure of the binding unit in the binding apparatus according to a second embodiment.

FIG. 11 is an explanatory diagram illustrating a structure of the binding unit 310*a* of the binding tool according to the second embodiment. The binding unit 310*a* according to the second embodiment includes a unit support shaft 360 in addition to the structure of the binding unit 310 according to the first embodiment described above.

In the structure of the binding unit 310*a*, the clamping unit 320 moves along the unit shaft 350. The binding unit 310*a* includes the unit support shaft 360 that is a shaft parallel to the unit shaft 350 and disposed at a position that support the movement of the clamping unit 320.

The unit support shaft 360 is disposed a lower portion of the clamping unit 320 in a direction of gravitational force and pass through a hole in the direction of movement of the clamping unit 320, and the hole has a clearance that allows the clamping unit 320 to slide in the hole. This unit support shaft 360 reduces the vibration and shakiness of the clamping unit 320 in the direction of gravitational force and prevents an occurrence of a misalignment of binding positions, which are caused by the binding processes and the movement of the clamping unit 320.

Next, a third embodiment of the binding tool in the binding apparatus according to the present disclosure is described.

Figure 12:
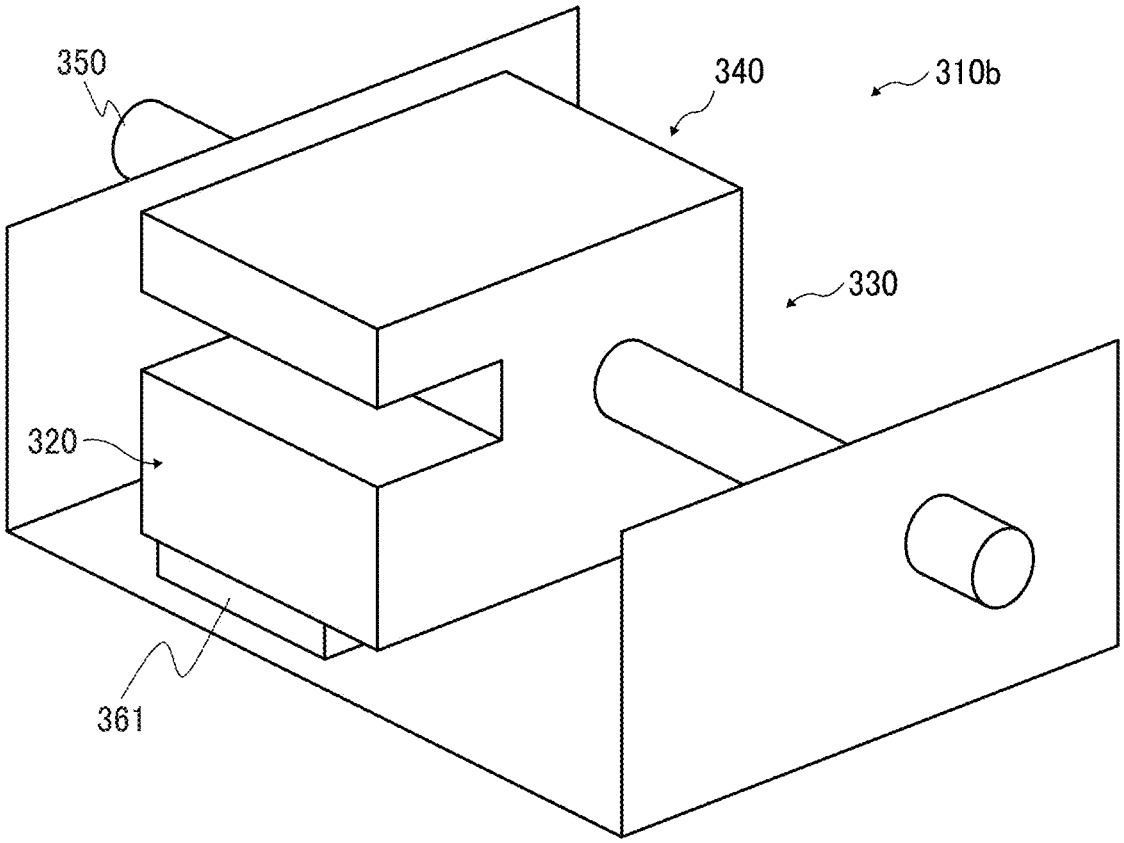
FIG. 12 is an explanatory diagram illustrating a structure of the binding unit in the binding apparatus according to a third embodiment.

FIG. 12 is an explanatory diagram illustrating a structure of the binding unit 310 of the binding tool according to the third embodiment. The binding unit 310*b* according to the third embodiment includes a unit support slider 361 in addition to the structure of the binding unit 310 according to the first embodiment described above.

Similar to the first embodiment described above, the binding unit 310*b* has a structure to move the clamping unit 320 along the unit shaft 350. The binding unit 310*a* includes, under the clamping unit 320, a unit support slider 361 as a member to support the movement of the clamping unit 320 parallel to the unit shaft 350.

The unit support slider 361 is disposed between the inner wall surface of the housing of the binding unit 310*b* and the lower face of the clamping unit 320 in the direction of the gravitational force to stop movement toward the direction of the gravitational force when the clamping unit 320 moves and operates. This unit support slider 361 reduces the vibration and shakiness of the clamping unit 320 in the direction of gravitational force and prevents an occurrence of a misalignment of binding positions, which are caused by the binding processes and the movement of the clamping unit 320.

The binding unit 310*b* according to the third embodiment may further include the unit support shaft 360 according to the second embodiment.

Next, a fourth embodiment of the binding tool in the binding apparatus according to the present disclosure is described.

Figure 13:
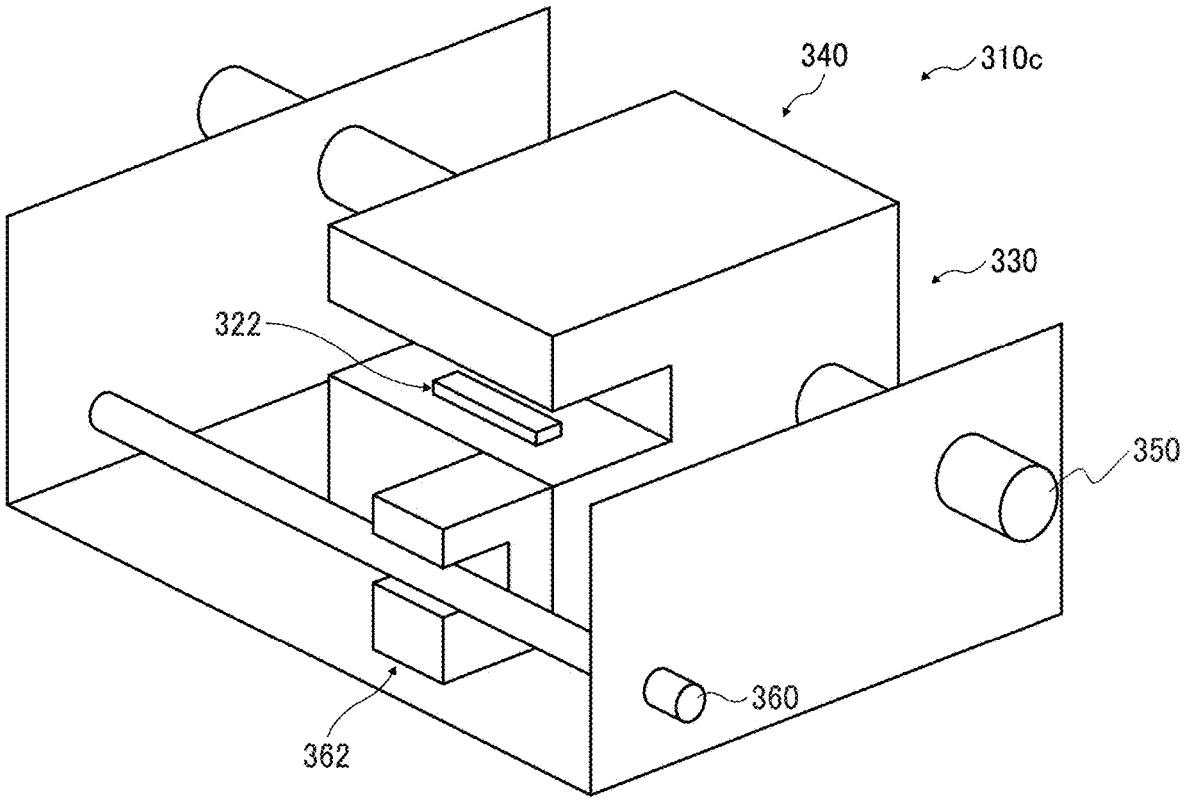
FIG. 13 is an explanatory diagram illustrating a structure of the binding unit in the binding apparatus according to a fourth embodiment.

FIG. 13 is an explanatory diagram illustrating a structure of the binding unit 310*c* of the binding tool according to the fourth embodiment. The binding unit 310*c* according to the fourth embodiment includes a clamping unit supporter 362 in addition to the structure of the binding unit 310 according to the first embodiment described above and the structure of the binding unit 310*b* according to the second embodiment.

The binding unit 310*c* has the structure to move the clamping unit 320 along the unit shaft 350 and includes the unit support shaft 360 in front of the side portion of the clamping unit 320. In addition, the binding unit 310*c* includes a clamping unit supporter 362 to suspend the clamping unit 320 on the unit support shaft 360 in front of the side portion of the clamping unit 320.

The unit support shaft 360 and the clamping unit supporter 362 stop the shakiness of the clamping unit 320 during the movement of the clamping unit 320 and the shakiness of the clamping unit 320 at the binding stop positions.

Additionally, in the binding unit 310*c*, the binding teeth 322 is arranged between the unit shaft 350 and the unit support shaft 360. This arrangement avoids an occurrence of a rotational moment caused by a large load when the binding teeth 322 executes the binding process and reduces the shakiness of the binding unit 310*c*. This prevents the occurrence of the misalignment of binding positions.

Next, a fifth embodiment of the binding tool in the binding apparatus according to the present disclosure is described.

Figure 14:
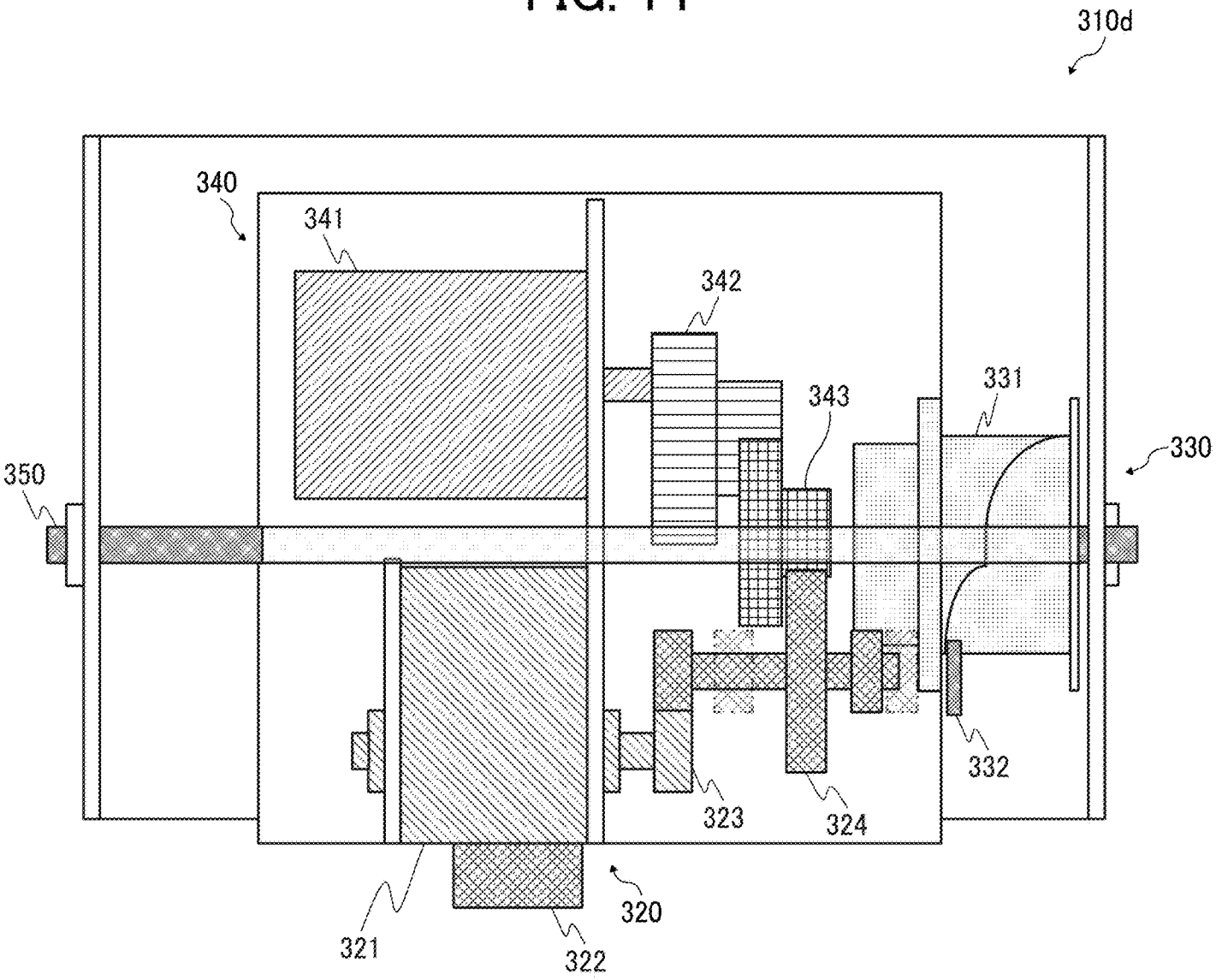
FIG. 14 is an explanatory diagram illustrating a structure of the binding unit in the binding apparatus according to a fifth embodiment.

FIG. 14 is an explanatory diagram illustrating a structure of the binding unit 310*d* of the binding tool according to the fifth embodiment. The binding unit 310*d* according to the fifth embodiment includes a drive switching mechanism 324 in addition to the structure of the binding unit 310 according to the first embodiment described above.

The drive switching mechanism 324 includes gears and an electromagnetic clutch or a solenoid, and the controller 61 controls the drive switching mechanism 324 to drive the electromagnetic clutch or the solenoid to change the positions of the gears. The drive switching mechanism 324 switches between transmitting the driving force from the drive motor 341 to the cam 331 included in the clamping unit controller 330 and transmitting the drive force to the binding teeth 322 included in the clamping unit 320. That is, the drive switching mechanism 324 is configured to switch the transmission destination of the driving force when the binding unit 310*d* executes the binding job.

For example, when the binding unit 310*d* executes the first binding process in step S708 of the flow chart in FIG. 7 and the second binding process in step S710 of the flow chart in FIG. 7, the drive switching mechanism 324 transmits the driving force from the drive motor 341 to the binding teeth 322 directly. When the binding teeth move in step S709, the drive switching mechanism 324 transmits the driving force from the drive motor 341 to the cam 331.

Therefore, the controller 61 controls the binding unit 310*d*, for example, to perform a switching operation between the first binding process in step S708 of FIG. 7 and the movement of the binding teeth 322 in step S709 of FIG. 7. Similarly, the controller 61 controls the binding unit 310*d* to perform the switching operation between the movement of the binding teeth 322 in step S709 and the second binding process in step S710.

The binding unit 310*d* according to the fifth embodiment does not need the driver for the movement of the binding teeth 322 and the driver for the binding processes separately, which reduces the heavy component included in the binding unit 310*d*. This structure reduces the vibration of the binding teeth 322 during the binding job and stabilizes the binding job. In addition, this structure reduces the cost of the binding unit 310*d*.

Further, compared with the binding unit 310 according to the first embodiment, the binding unit 310*d* does not need to synchronize the processes performed by the clamping controller 321 in the clamping unit 320 with the movement of the clamping unit 320 caused by the rotation of the cam 331 rotated by the drive motor 341. This facilitates adjustment during assembly of the binding unit.

Next, a sixth embodiment of the binding tool in the binding apparatus according to the present disclosure is described.

Figure 15:
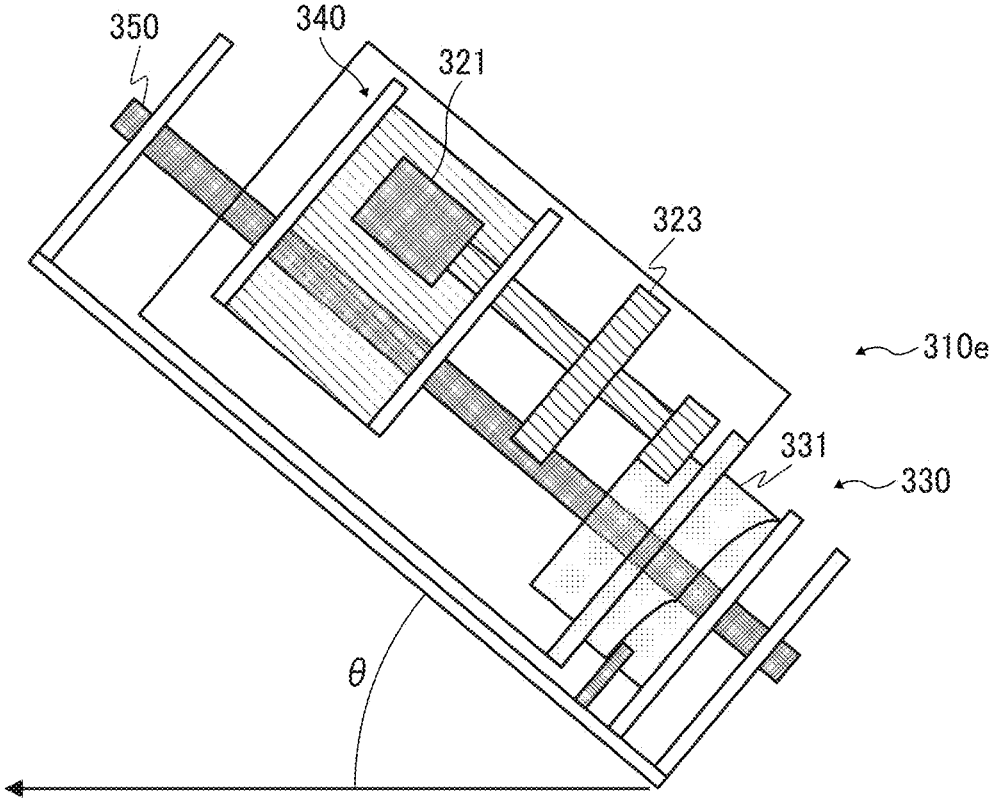
FIG. 15 is an explanatory diagram illustrating a structure of the binding unit in the binding apparatus according to a sixth embodiment.

FIG. 15 is an explanatory diagram illustrating a structure of the binding unit 310*e* of the binding tool according to the sixth embodiment. The binding unit 310*e* according to the sixth embodiment is installed in the post-processing apparatus 3 and set to be inclined with an inclination of θ degrees with respect to the floor surface on which the post-processing apparatus 3 is placed.

In the binding unit 310*e*, at the beginning of the binding job, the binding teeth 322 is at the center position between the first binding position and the second binding position. In the binding unit 310*e*, the first binding position is set relatively lower than the center position at which the binding unit 310*e* exists at the beginning to the binding job, and the second binding position is set upper than the center position. The controller 61 controls the operations in the binding job.

The controller 61 controls the binding unit 310*e* to firstly move the binding teeth 322 to the lower position to execute the first binding process and secondly move the binding teeth 322 to the upper position to execute the second binding process. This structure does not cause an impact caused by the movement of the binding unit 310*e* when the binding unit 310*e* moves to the second binding position after the first binding process and reduce the shakiness of the binding teeth 322. As a result, this structure reduces the misalignment of the binding positions.

Next, a description is given of another embodiment of the image forming system according to the present disclosure.

Figure 16:
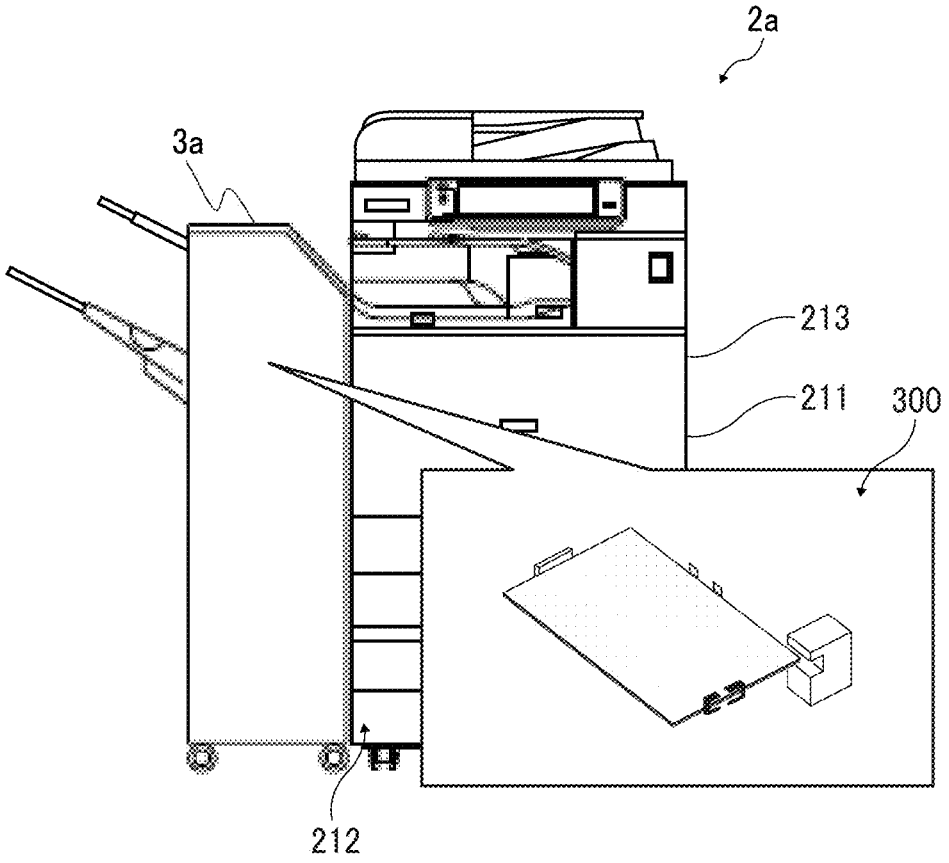
FIG. 16 is a diagram illustrating an image forming system according to the present disclosure.

As illustrated in FIG. 16, the next stage of the printer 2*a* according to the present embodiment is coupled to the post-processing apparatus 3*a* including the binding apparatus 300 described in the above embodiments.

The printer 2*a* forms the image on both sides or one side of the sheet 4 based on image data input from an external device such as a personal computer or image data read by a scanner included in the copier. Although the printer 2*a* in the present embodiment employs the electrophotographic system as the image forming method, the printer 2*a* may employ any other method such as an inkjet method or a thermal transfer method.

The present disclosure is not limited to the above-described embodiments, and the configuration of the present embodiment can be appropriately modified other than suggested in each of the above embodiments within a scope of the technological concept of the present disclosure. Also, the positions, the shapes, and the number of components are not limited to the embodiments, and they may be modified suitably in implementing the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above.

Each of the functions of the described embodiments may be implemented by one or more processing circuits or control circuitry. Processing circuits includes a programmed processor, as a processor includes control circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A binding apparatus comprising:

a binding tool configured to execute a first binding process at a first binding position on a sheet bundle and configured to execute a second binding process at a second binding position, different from the first binding position, on the sheet bundle;

a binding tool driver, configured to apply both a driving force to move the binding tool to the first binding position and to the second binding position, and a driving force to execute the first binding process and the second binding process; and a main shaft, disposed between the binding tool and the binding tool driver, to support movement of the binding tool to the first binding position and to the second binding position by application of the driving force to move the binding tool.

2. The binding apparatus of claim 1, further comprising:

a support shaft, configured to support the binding tool when the binding tool moves along the main shaft.

3. The binding apparatus of claim 2, wherein the binding tool is disposed between the main shaft and the support shaft, in a horizontal direction.

4. The binding apparatus of claim 1, wherein the binding tool driver includes a transmitter, configured to transmit the driving force.

5. The binding apparatus of claim 1, wherein the binding tool driver includes a switching assembly, configured to switch between applying the driving force to the binding tool to execute the first binding process or to execute the second binding process, and applying the driving force to the binding tool driver to move the binding tool to the first binding position and to the second binding position.

6. The binding apparatus of claim 1, further comprising control circuitry configured to cause the binding tool to:

move the first binding position relatively lower than a position at which the binding tool is located before the first binding process begins;

execute the first binding process;

move the second binding position relatively higher than the position at which the binding tool is located before the first binding process begins; and execute the second binding process.

7. An image forming apparatus comprising:

an image forming section configured to form an image on a sheet-like medium;

a conveyor configured to convey the sheet-like medium on which the image is formed in the image forming section; and a post-processing apparatus, including the binding apparatus of claim 1, the post-processing apparatus being configured to stack, align, and bind sheet-like media, including the sheet-like medium conveyed by the conveyance unit.

8. An image forming system comprising:

an image forming apparatus configured to form an image on a sheet-like medium;

a post-processing apparatus, including a binding apparatus to bind a sheet bundle including the sheet-like medium on which the image is formed in the image forming apparatus, the binding apparatus including:

a binding tool, configured to execute a first binding process at a first binding position on a sheet bundle and configured to execute a second binding process at a second binding position, different from the first binding position, on the sheet bundle;

a binding tool driver, configured to apply both a driving force to move the binding tool to the first binding position and to the second binding position, and a driving force to execute the first binding process and the second binding process; and a main shaft, disposed between the binding tool and the binding tool driver, and configured to support movement of the binding tool to the first binding position and to the second binding position by application of the driving force to move the binding tool.

9. The image forming system of claim 8, wherein the binding apparatus further includes:

a support shaft, configured to support the binding tool when the binding tool moves along the main shaft.

10. The image forming system of claim 9, wherein the binding tool is disposed between the main shaft and the support shaft, in a horizontal direction.

11. The image forming system of claim 8, wherein the binding tool driver includes a transmitter, configured to transmit the driving force.

12. The image forming system of claim 8, wherein the binding tool driver includes a switching assembly, configured to switch between applying the driving force to the binding tool to execute the first binding process or to execute the second binding process, and applying the driving force to the binding tool driver to move the binding tool from the first binding position to the second binding position.

13. The image forming system of claim 8, wherein binding apparatus further includes control circuitry configured to cause the binding tool to:

move the first binding position relatively lower than a position at which the binding tool is located before the first binding process begins;

execute the first binding process;

move the second binding position relatively higher than the position at which the binding tool is located before the first binding process begins; and execute the second binding process.

* * * * *